US007034795B2

(12) United States Patent
Maeda et al.

(10) Patent No.: US 7,034,795 B2
(45) Date of Patent: Apr. 25, 2006

(54) MATRIX IMAGE DISPLAY DEVICE

(75) Inventors: Kazuhiro Maeda, Nara (JP); Hajime Washio, Sakurai (JP); Yasushi Kubota, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 385 days.

(21) Appl. No.: 10/208,757

(22) Filed: Aug. 1, 2002

(65) Prior Publication Data

US 2003/0030615 A1 Feb. 13, 2003

(30) Foreign Application Priority Data

Aug. 7, 2001 (JP) ..... 2001-239859

(51) Int. Cl.
*G06G 3/36* (2006.01)

(52) U.S. Cl. ..... 345/99; 345/96

(58) Field of Classification Search ..... 345/42, 345/51, 54, 90, 92, 96, 99
See application file for complete search history.

(56) References Cited

U.S. PATENT DOCUMENTS

| | | | | |
|---|---|---|---|---|
| 2001/0011987 | A1* | 8/2001 | Kubota et al. | 345/98 |
| 2001/0022572 | A1* | 9/2001 | Murade | 345/98 |
| 2002/0149553 | A1* | 10/2002 | Tsujimura et al. | 345/92 |
| 2003/0206149 | A1* | 11/2003 | Yamashita et al. | 345/92 |

FOREIGN PATENT DOCUMENTS

| | | |
|---|---|---|
| JP | 01-116592 | 5/1989 |
| JP | 02-240687 | 9/1990 |
| JP | 4-140716 A | 5/1992 |
| JP | 4-282610 A | 10/1992 |
| JP | 04-309920 | 11/1992 |
| JP | 06-095071 | 4/1994 |
| JP | 07-056544 | 3/1995 |
| JP | 7-72830 A | 3/1995 |
| JP | 08-322005 | 12/1996 |
| JP | 11-38379 A | 2/1999 |
| JP | 11-142807 | 5/1999 |
| JP | 11-352462 | 12/1999 |

OTHER PUBLICATIONS

Korean Office Action mailed Nov. 29, 2004 (w/English translation thereof).
Japanese Office Action mailed Sep. 20, 2005 (w/English translation thereof).

* cited by examiner

*Primary Examiner*—Kent Chang
(74) *Attorney, Agent, or Firm*—Nixon & Vanderhye P.C.

(57) ABSTRACT

The scanning signal line driving circuit sequentially carries out active driving with respect to each set of a certain number of scanning signal lines which are adjacent to each other in a vertical direction, and when carrying out an actual writing with respect to a first set of a certain number of pixel lines adjacent to each other in the vertical direction, carries out pre-charging with respect to a second set of the certain number of pixel lines to which the actual writing is carried out next with a potential of a same polarity as that of the first set of the certain number of pixel lines. In this manner, it is possible to provide a matrix image display device with no irregularities in display quality and is capable of matching the apparent vertical resolution of the device to that of the image source, when using an image signal of vertical resolution lower than the maximum physical vertical resolution of the device.

27 Claims, 17 Drawing Sheets

PRE-CHARGING FOR PROVIDING THE SAME POTENTIAL AS PIXLIN1 AND PIXLIN2

MATRIX IMAGE DISPLAY DEVICE

FIELD OF THE INVENTION

The present invention relates to a matrix image display device such as a liquid crystal display device, and in particular to a driving method of scanning signal lines of a matrix image display device which has no irregularities in display quality and is capable of matching the apparent vertical resolution of the device to that of the image source, when using an image signal of vertical resolution lower than the maximum physical vertical resolution of the device.

BACKGROUND OF THE INVENTION

The following will explain an active matrix display device as an example of a conventional image display device.

As shown in FIG. 11, the image display device is made up of a pixel array 51, a scanning signal line driving circuit 52 and a data signal line driving circuit 53. The pixel array 51 includes a plurality of scanning signal lines GL1, GL2, . . . GLy and a plurality of data signal lines SL1, SL2, . . . SLx, which are provided by crossing each other. Also, pixels 54 are provided in a matrix manner on the pixel array 51 between two adjacent scanning signal lines GLy-1 and GLy, and two adjacent data signal lines SLx-1 and SLx.

The data signal line driving circuit 53 samples an inputted image signal DAT in synchronism with a timing signal such as a source clock signal SCK, and amplifies the image signal if necessary, then write the signal to the data signal lines SL1, SL2, . . . SLx.

The scanning signal line driving circuit 52 sequentially selects the scanning signal lines GL1, GL2, . . . GLy in synchronism with a timing signal such as a gate clock signal GCK, and write the image signal DAT thus written on the data signal lines SL1, SL2, . . . SLx to the pixels 54 by turning on/off switching element (not shown) in the pixels 54, and holds the image signal DAT written in a memory in the pixels 54.

Incidentally, in a conventional active matrix display device, the data signal line driving circuit 53 and the scanning signal line driving circuit 52 are generally provided as external ICs (Integrated Circuits), as shown in FIG. 11. However, in recent years, a new technique has been revealed such as the arrangement of FIG. 12 such that a pixel array 61, a data signal line driving circuit 63 and a scanning signal line driving circuit 62 are monolithically formed on a single insulating substrate 65. Further, a control circuit 66 for supplying various signals and a power supply circuit 67 are connected to the driving circuits 62 and 63.

Here, in the conventional active matrix display device, the following will explain an arrangement example of the scanning signal line driving circuit 62 which drives the scanning signal lines GL1, GL2, . . . GLy, and also explain the driving method thereof.

As shown in FIG. 13, a common scanning signal line driving circuit 62 is made up of a plurality of shift registers SR1 through SRn, waveform shaping circuits PP1 through PPn and buffer circuits 71. The plurality of shift registers SR1 through SRn sequentially shift active state of externally inputted gate start pulse signal GSP in synchronism with a gate clock signal GCK and its inversion signal GCKB, which are also externally inputted. The waveform shaping circuits PP1 through PPn shape the waveforms outputted from the shift registers SR1 through SRn to desired shapes. The buffer circuits 71 transmit the outputs from the waveform shaping circuits PP1 through PPn to the scanning signal lines GL1, GL2, . . . GLn.

FIG. 14 shows the timing waveform of the scanning signal line driving circuit 62 having the foregoing arrangement. As shown in the figure, the active state of the gate start pulse signal GSP is sequentially shifted in synchronism with the gate clock pulse signal GCK, and outputted as output signals SRO1, SRO2, . . . SROn of the shift registers SR1 through SRn. Then, these output signal SRO1, SRO2, . . . SROn of the shift registers SR1 through SRn are outputted as output signals GO1 through GOn by being shaped and shortened in wave width by each of the waveform shaping circuits PP1 through PPn so as to be. Further, these outputted signals GO1 through GOn are inputted to the buffer circuits 71, and then are outputted as actual driving waveforms of the scanning signal lines GL1, GL2, . . . GLn.

Generally, each of the shift registers SR1 through SRn provides vertical resolution corresponding to the number of the scanning signal lines GL1, GL2, . . . GLy. Therefore, the scanning signal lines GL1, GL2, . . . GLn are individually driven at different timings by the shift registers SR1 through SRn so as to respectively write an individual image signal DAT on the pixels 64 connected to scanning signal lines GL1 through GLy shown in FIG. 12 in a parallel direction to the data signal lines SL1, SL2, . . . SLx. This is a physical display resolution of the maximum value in a vertical direction of the image display device and makes it possible to carry out display close to an image source as much as possible when the inputted image signal DAT has the same level of vertical resolution or greater.

On the other hand, when the inputted image signal DAT has vertical resolution lower than the maximum physical display resolution in a vertical direction of the image display device, for example, in the case of displaying an image signal of SVGA (800 (horizontal)×600 (vertical) pixels) with an image display device having a maximum physical display resolution of UXGA (1600 (horizontal)×1200 (vertical) pixels), generally, a method which sequentially drives a plurality of adjacent scanning signal lines GLy−1 and GLy is adopted.

With the method, it becomes possible to respectively write the same value data on the pixel lines corresponding to the plurality of the scanning signal lines GL1, GL2, . . . GLy in a parallel direction to the data signal lines SL1, SL2, . . . SLx, thereby matching the apparent vertical resolution to the vertical resolution of the image signal.

More specifically, in high vertical resolution driving, which is shown in FIG. 14, the scanning signal lines GL1, GL2, GL3, . . . GLy are individually driven at different timings by the outputs GO1, GO2, . . . Gon. Then, individual data is respectively written on the pixel lines corresponding to the scanning signal lines GL1, GL2, GL3, . . . GLy in a parallel direction to the data signal lines SL1, SL2, . . . SLx, thereby realizing high vertical resolution driving.

On the other hand, in ½ vertical resolution driving, which is shown in FIG. 15, the driving is performed by sequentially driving a set of two adjacent scanning signal lines such as the scanning signal lines GL1 and GL2, scanning signal lines GL3 and GL4 . . . scanning signal lines GLm and GLm+1 (m is an odd number). Then, the same value data is respectively written on the pixel lines corresponding to each of the scanning signal lines in a parallel direction to the data signal lines SL1, SL2, . . . SLx, thereby realizing ½ vertical resolution driving.

The foregoing explanation deals with a general driving method of the scanning signal line driving circuit 62.

However, the conventional matrix image display device has the following problems when an image having low vertical resolution is displayed in an image display device having high vertical resolution.

In the described arrangement, when a plurality of scanning signal lines are driven at the same time, potential variance with respect to pixel lines above and below and adjacent to the plurality of scanning signal lines greatly differ from each other, after data is written to the plurality of pixels thus simultaneously driven. Accordingly, there arises a problem where potential variances differ between the pixels corresponding to the plurality of scanning signal lines GL1 through GLn, which are subject to writing the same value data and are driven by a common coupling capacitor for each pixels.

Namely, as shown in FIG. 16, in the case of driving two scanning signal lines such as the scanning signal lines GL1 and GL2, scanning signal lines GL3 and GL4, and the scanning signal lines GL5 and GL6, the potentials of a pixel line PIXLIN 3 and a pixel line PIXLIN 4 differ as shown in FIG. 17 which are supposed to have the same value. This is due to the difference of the potential variances between a pixel line PIXLIN 2 and a pixel line PIXLIN 5, as the potential variances of these pixel lines affect the pixel line PIXLIN 3 and the pixel line PIXLIN 4. This difference appears as a streaky defect in a parallel direction to the scanning signal lines GL1 through GLn of the image display, thereby decreasing display quality.

Further, when liquid crystal is used as an image display element, inversion of the image signal DAT have to be repeated with a certain period for its reliability, and great potential variance (normally about 10V for example) is occurred before and after the inversion.

Here, FIGS. 18(*a*) through 18(*c*) show the methods of inversion. FIG. 18(*a*) shows a 1H inversion driving which carries out inversion every 1 horizontal period. Further, FIG. 18(*b*) shows a 1V inversion driving which carries out inversion every 1 vertical period. Further, FIG. 18(*c*) shows a dot inversion driving which carries out inversion every 1 dot and every 1 vertical period.

Among those three methods, the 1H inversion driving of FIG. 18(*a*) and the dot inversion driving of FIG. 18(*c*) are often adopted in terms of display quality. However, the foregoing problem becomes more prominent when the 1H inversion driving and the dot inversion driving are adopted, as those inversions are performed between the adjacent pixel lines in the data signal line direction.

SUMMARY OF THE INVENTION

The present invention is made in view of the foregoing conventional problems, and an object is to provide a matrix image display device which has no irregularities in display quality and is capable of matching the apparent vertical resolution of the device to that of the image source, when using an image signal of vertical resolution lower than the maximum physical vertical resolution of the device.

In order to solve the foregoing problems, a matrix image display device of the present invention includes:

a plurality of pixels disposed in a matrix manner;

a plurality of data signal lines disposed on columns of the respective pixels, and a plurality of scanning signal lines disposed corresponding to lines of the respective pixels;

a display section which accepts and holds image signals for displaying images in the respective pixels from the data signal lines in synchronism with scanning signals supplied from the scanning signal lines;

a data signal line driving circuit which outputs the image signals to the respective data signal lines in synchronism with predetermined timing signals for the respective data signal lines; and a scanning signal line driving circuit which outputs the scanning signals to the respective scanning signal lines in synchronism with predetermined timing signals for the respective scanning signal lines, wherein:

the scanning signal line driving circuit (a) sequentially carries out active driving with respect to each set of a certain number of scanning signal lines which are adjacent to each other in a vertical direction, and when carrying out an actual writing with respect to a first set of a certain number of pixel lines adjacent to each other in the vertical direction, (b) carries out pre-charging with respect to a second set of the certain number of pixel lines to which the actual writing is carried out next with a potential of the same polarity as that of the first set of the certain number of pixel lines.

With the foregoing arrangement, the scanning signal line driving circuit sequentially carries out active driving with respect to each set of a certain number of scanning signal lines which are adjacent to each other in a vertical direction. For example, in the scanning signal lines GL1 through GLn, the scanning signal line driving circuit sequentially carries out driving with respect to each set of scanning signal lines GL2n−1 and GL2n (n is a positive even number), thereby obtaining ½ vertical resolution.

Incidentally, in a conventional matrix image display device, when each set of scanning signal lines is driven in this manner, potential variances of the scanning signal lines above and below and adjacent to the set of scanning signal lines affect on a scanning signal of the set of scanning signal lines.

However, in the present invention, when carrying out an actual writing with respect to a first set of a certain number of pixel lines adjacent to each other in the vertical direction, pre-charging is carried out with respect to a second set of the certain number of pixel lines to which the actual writing is carried out next with a potential of the same polarity as that of the first set of the certain number of pixel lines.

Accordingly, potential variance of the pixel lines of the first set of scanning signal lines gives little effect on the scanning signal of the second set of scanning signal lines, since the pixels of the first set are driven before the actual writing for the second set of scanning signal lines.

Meanwhile, potential variance of the pixel lines of the third set of the scanning signal lines gives unwanted effect on the second set of the scanning signal lines.

However, in the present invention, the pixel lines of the third set of the scanning signal lines are pre-charged before the actual writing. Therefore, the potential variance of the pixel lines of the third set of the scanning signal lines is suppressed when the actual writing is carried out. Further, the pre-charging is carried out with respect to the second set of the certain number of pixel lines to which the actual writing is carried out next. The pre-charging is carried out at the same time of the actual writing of the first set of the certain number of pixel lines with a potential of the same polarity. Namely, the pre-charging is carried out with the same potential as that of the actual writing.

As a result, it is possible to suppress the effect on the second set of the scanning signal lines by the potential variance of the pixel lines of the third set of the scanning signal lines since the potential variance of the third set of the scanning signal lines is reduced.

Further, the potential for the actual writing on the nearest pixel is used for the potential of the pre-charging with respect to the set of the certain number of scanning signal lines. Therefore, it is not necessary to input an extra signal for the pre-charging, and besides, the potential of the pre-charging is close to the potential of the actual writing.

Consequently, it is possible to provide a matrix image display device which has no irregularities in display quality and is capable of matching the apparent vertical resolution of the device to that of the image source, when using an image signal of vertical resolution lower than the maximum physical vertical resolution of the device.

Further, in order to solve the foregoing problems, the matrix image display device of the present invention includes:

a plurality of pixels disposed in a matrix manner;

a plurality of data signal lines disposed on columns of the respective pixels, and a plurality of scanning signal lines disposed corresponding to lines of the respective pixels;

a display section which accepts and holds image signals for displaying images in the respective pixels from the data signal lines in synchronism with scanning signals supplied from the scanning signal lines;

a data signal line driving circuit which outputs the image signals to the respective data signal lines in synchronism with predetermined timing signals for the respective data signal lines; and a scanning signal line driving circuit which outputs the scanning signals to the respective scanning signal lines in synchronism with predetermined timing signals for the respective scanning signal lines, wherein:

the scanning signal line driving circuit (a) sequentially carries out active driving with respect to each set of a certain number of scanning signal lines which are adjacent to each other in a vertical direction, and when carrying out an actual writing with respect to a first set of a certain number of pixel lines adjacent to each other in the vertical direction, (b) carries out pre-charging with respect to pixels in an earliest line of a second set of the certain number of pixel lines to which the actual writing is carried out next with a potential of the same polarity as that of the first set of the certain number of pixel lines.

Namely, in order to prevent the irregularities in display quality, as long as the unwanted effect of the potential variance of the pixels in the earliest line is suppressed, it is not necessary to suppress the effect of both pixel lines of the set to which the actual writing is carried out next.

Therefore, in the present invention, when the actual writing is carried out with respect to the first set of the certain number of pixel lines, the pre-charging is carried out with respect to pixels in the earliest line of the second set of the certain number of pixel lines to which the actual writing is carried out next.

Namely, the pre-charging is carried out to only the pixels in the earliest line of the set of the pixel lines to which the actual writing is carried out next.

As a result, the pre-charging consumes minimum power, and power consumption can be reduced.

Further, in order to solve the foregoing problems, the matrix image display device of the present invention includes:

a plurality of pixels disposed in a matrix manner;

a plurality of data signal lines disposed on columns of the respective pixels, and a plurality of scanning signal lines disposed corresponding to lines of the respective pixels;

a display section which accepts and holds image signals for displaying images in the respective pixels from the data signal lines in synchronism with scanning signals supplied from the scanning signal lines;

a data signal line driving circuit which outputs the image signals to the respective data signal lines in synchronism with predetermined timing signals for the respective data signal lines; and a scanning signal line driving circuit which outputs the scanning signals to the respective scanning signal lines in synchronism with predetermined timing signals for the respective scanning signal lines, wherein:

the scanning signal line driving circuit includes:

selecting and switching means for switching between;

(i) an operation for respectively driving each of the scanning signal lines, and (ii) an operation for sequentially carrying out active driving with respect to each set of a certain number of scanning signal lines which are adjacent to each other in a vertical direction, and when carrying out an actual writing with respect to a first set of a certain number of pixel lines adjacent to each other in the vertical direction, (b) carries out pre-charging with respect to a second set of the certain number of pixel lines to which the actual writing is carried out next with a potential of the same polarity as that of the first set of the certain number of pixel lines.

With the foregoing invention, by using the selecting and switching means, it is possible to switch and select between the operation for respectively driving each of the scanning signal lines, and the operation for sequentially carrying out active driving with respect to each set of a certain number of scanning signal lines which are adjacent to each other in a vertical direction, and when carrying out an actual writing with respect to a first set of a certain number of pixel lines adjacent to each other in the vertical direction, carrying out pre-charging with respect to a second set of the certain number of pixel lines to which the actual writing is carried out next with a potential of the same polarity as that of the first set of the certain number of pixel lines.

Consequently, it is possible to maintain high quality of both high vertical resolution display and low vertical resolution display.

Additional objects, features, and strengths of the present invention will be made clear by the description below. Further, the advantages of the present invention will be evident from the following explanation in reference to the drawings.

DESCRIPTION OF THE EMBODIMENTS

The following will explain one embodiment of the present invention with reference to FIGS. 1 through 10.

Figure 2:
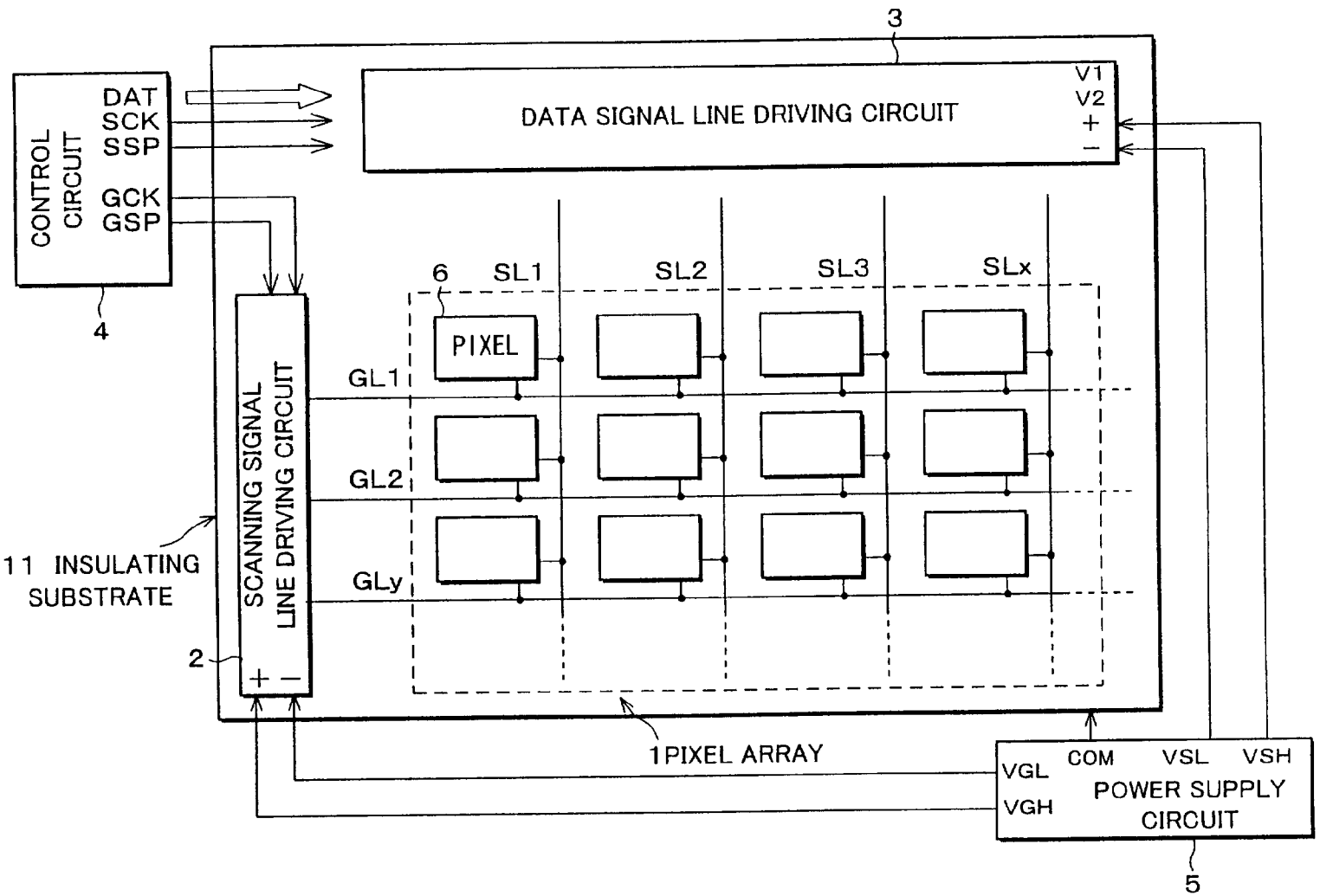
FIG. 2 is a drawing showing a structure of the matrix image display device.

As shown in FIG. 2, a matrix image display device of the present embodiment includes a pixel array 1 as a display section, a scanning signal line driving circuit 2 and a data signal line driving circuit 3, which are monolithically formed on a single insulating substrate 11. Thus monolithically forming the scanning signal line driving circuit 2 and the data signal line driving circuit 3 on the same substrate provides an effect of lower cost compared to the case where those driving circuits are respectively formed and mounted, and also results in an effect of high-reliability.

A control circuit 4 which supplies various control signals, and a power supply circuit 5 are connected to the scanning signal line driving circuit 2 and the data signal line driving circuit 3. Further, the pixel array 1 includes a plurality of data signal lines SL1, SL2, . . . SLx and a plurality of scanning signal lines GL1, GL2, . . . GLy, which are provided by crossing each other. Also, pixels 6 are provided in a matrix manner on the pixel array 1 between two adjacent data signal lines SLx−1 and SLx, and two adjacent scanning signal lines GLy−1 and GLy.

The data signal line driving circuit 3 samples an inputted image signal DAT in synchronism with a timing signal such as a source clock signal SCK, and amplifies the image signal if necessary, then write the signal to the data signal lines SL1, SL2, . . . SLx.

The scanning signal line driving circuit 2 sequentially selects the scanning signal lines GL1, GL2, . . . GLy in synchronism with a timing signal such as a gate clock signal GCK, and write the image signal DAT thus written on the data signal lines SL1, SL2, . . . SLx to the pixels 6 by turning on/off switching element (not shown) in the pixels 6, and holds the image signal DAT written in a memory in the pixels 6.

Figure 3:
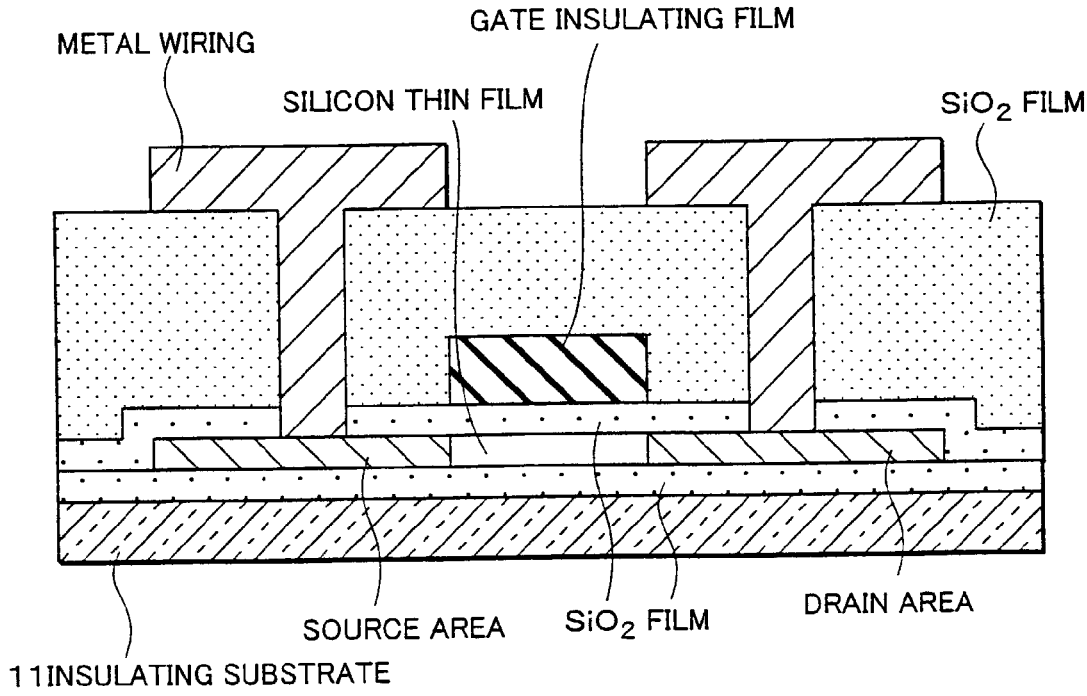
FIG. 3 is a cross-sectional view showing a polycrystalline silicon thin film transistor included in the matrix image display device.
Figure 4A:
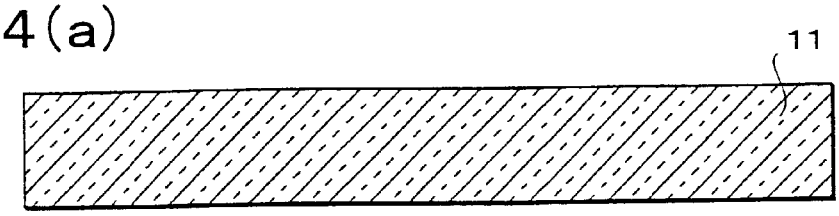
FIGS. 4(*a*) through 4(*f*) are explanatory views showing manufacturing process of the polycrystalline silicon thin film transistor included in the matrix image display device.
Figure 4B:
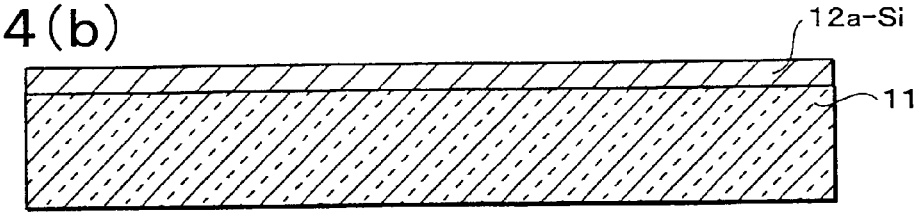
Figure 4C:
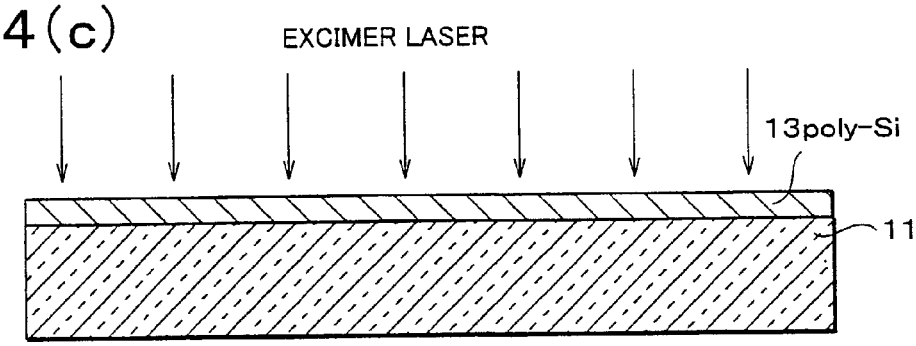
Figure 4D:
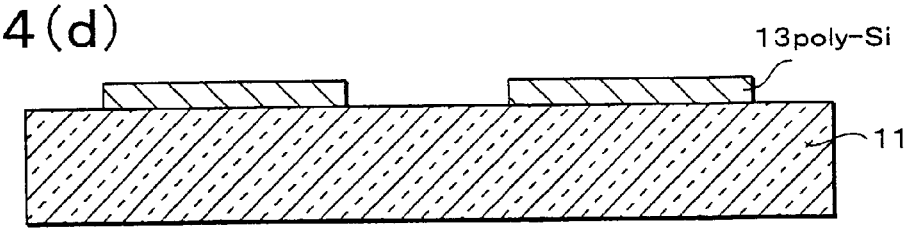
Figure 4E:
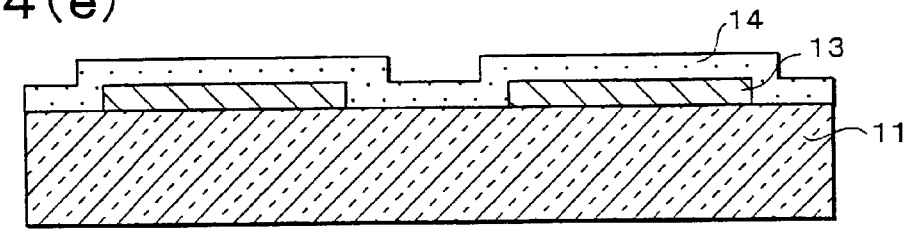
Figure 4F:
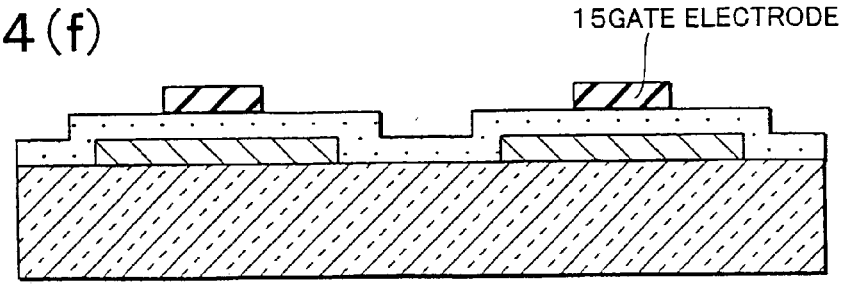
Figure 5A:
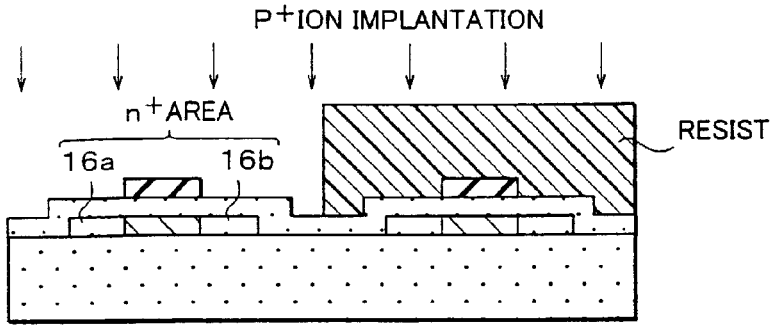
FIGS. 5(*a*) through 5(*e*) are explanatory views showing the next step of the manufacturing process of the polycrystalline silicon thin film transistor included in the matrix image display device followed by FIGS. 4(*a*) through 4(*f*).
Figure 5B:
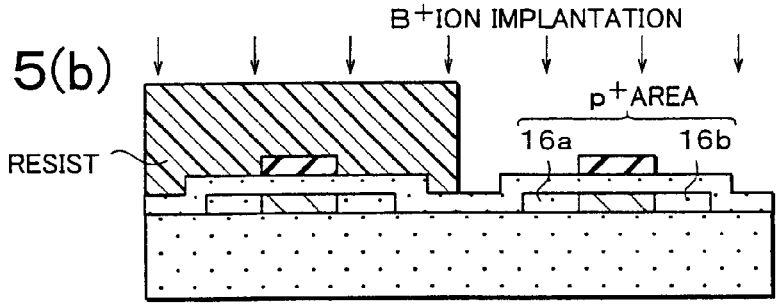
Figure 5C:
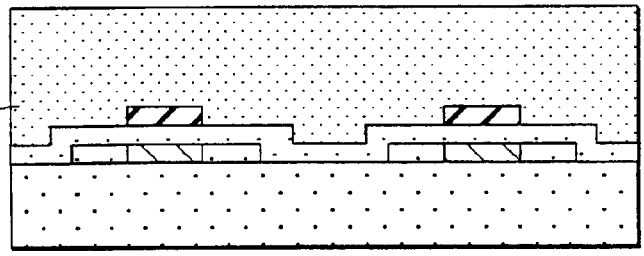
Figure 5D:
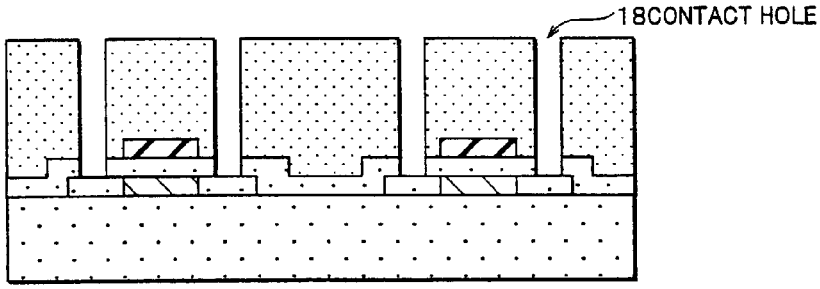
Figure 5E:
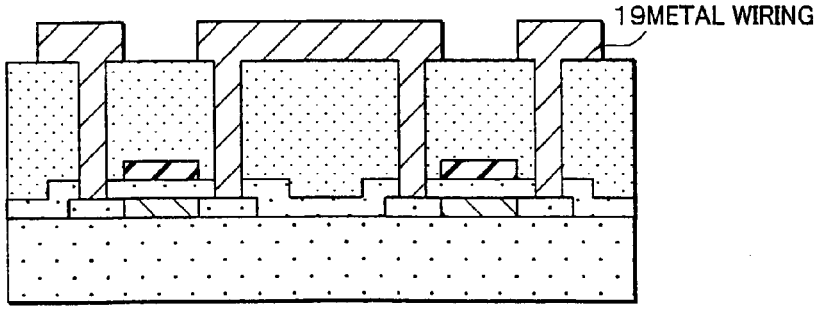

As shown in FIG. 3, a polycrystalline silicon thin film transistor included in the matrix image display device has a forward-stagger (top gate) structure where a polycrystalline silicon thin film is provided as an active layer on the insulating substrate 11. Note that, the polycrystalline silicon thin film transistor is not necessarily have to have this structure, and may have other structures such as a reverse-stagger structure. By thus using the polycrystalline silicon thin film transistor, it is possible to form the pixel array 1, and the scanning signal line driving circuit 2 and the data signal line driving circuit 3 having practical driving abilities, on the same substrate and by substantially the same manufacturing step.

Here, in the present embodiment, the polycrystalline silicon thin film transistor is formed at a temperature less than 600° C. The following will explain a manufacturing process of the polycrystalline silicon thin film transistor, which is formed at a temperature less than 600° C.

Firstly, as shown in FIG. 4(*a*) and FIG. 4(*b*), excimer laser is applied on an amorphous silicon thin film (a-Si) 12 which is stacked on an insulating substrate 11 made of glass. By thus applying the excimer laser on the amorphous silicon thin film (a-Si) 12, a polycrystalline silicon thin film (poly-Si) 13 is formed as shown in FIG. 4(*c*). Next, the polycrystalline silicon thin film (poly-Si) 13 is patterned to be a desired shape as shown in FIG. 4(*d*), and then a gate insulating film 14 of silicon dioxide is formed as shown in FIG. 4(*e*). Further, a gate electrode 15 for a thin film transistor is formed by using an aluminum or the like as shown in FIG. 4(*f*).

Next, as shown in FIG. 5(*a*) and FIG. 5(*b*), a source area 16*a* and a drain area 16*b* of the thin film transistor are impregnated with impurities (phosphorus for n-type area, boron for p-type area). Thereafter, an inter-layer insulating film 17 made of silicon dioxide or silicon nitride is stacked as shown in FIG. 5(*c*), then a contact hole 18 is opened as shown in FIG. 5(*d*). Further, a metal wiring 19 made of an aluminum or the like is formed as shown in FIG. 5(*e*).

In the manufacturing process, as the temperature for forming the gate insulating film 14 (the highest temperature in the process) is 600° C., a high heat resistant glass (e.g., product name "1737 glass" provided by Corning Inc. in the U.S.) can be used. Note that, for a matrix image display device, a transparent electrode (in the case of a transmission-type liquid crystal display device) or a reflection electrode (in the case of a reflection-type liquid crystal display device)

is further formed via another inter-layer insulating film (not shown) after the process above.

As described, with the manufacturing processes shown in FIGS. 4(*a*) through 4(*f*), and FIGS. 5(*a*) through 5(*e*), it is possible to form the polycrystalline silicon thin film transistor, and to use a glass substrate of large area with low cost. Therefore, it realizes a matrix image display device of lower cost and larger area.

The following will explain the structure of the scanning signal line driving circuit 2 of the foregoing matrix image display device and the driving method thereof. Note that, in the scanning signal line driving circuit 2 of the present embodiment, it is possible to select vertical resolution of physically maximum value, or vertical resolution of ½ of the maximum value. Namely, the scanning signal line driving circuit 2 is capable of changing the visible vertical resolution.

Figure 6:
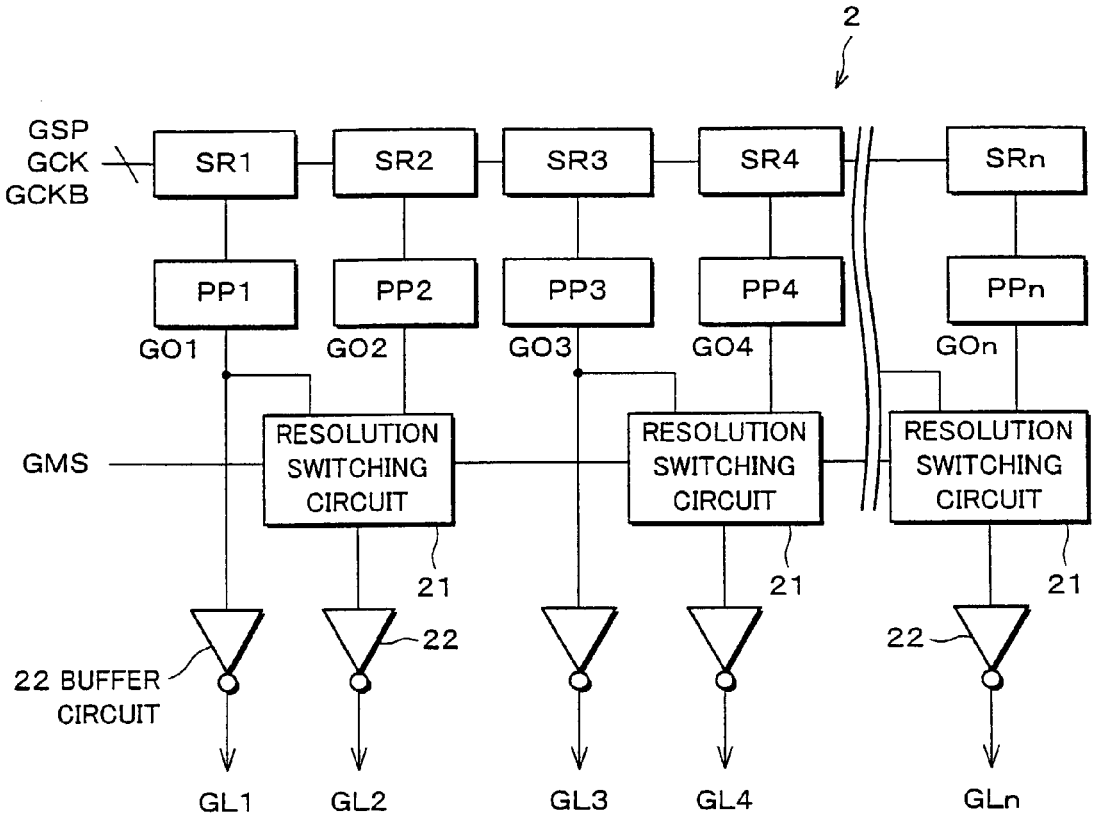
FIG. 6 is a block diagram showing a structure of the scanning signal line driving circuit of the matrix image display device.

As shown in FIG. 6, the scanning signal line driving circuit 2 with the foregoing structure is made up of a plurality of shift registers SR1 through SRn, waveform shaping circuits PP1 through PPn, resolution switching circuits 21 and buffer circuits 22. The plurality of shift registers SR1 through SRn sequentially shift active state of externally inputted gate start pulse signal GSP in synchronism with a gate clock signal GCK and its inversion signal GCKB, which are also externally inputted. The waveform shaping circuits PP1 through PPn shape the waveforms outputted from the shift registers SR1 through SRn to desired shapes. The resolution switching circuits 21 are selecting and switching means for switching the connection between an output line of the waveform shaping circuits PP1 through PPn and the buffer circuits 22 in accordance with an externally inputted resolution switching signal GMS. The buffer circuits 22 transmit the outputs from the resolution switching circuits 21 to the scanning signal lines GL1, GL2, . . . GLn.

Figure 13:
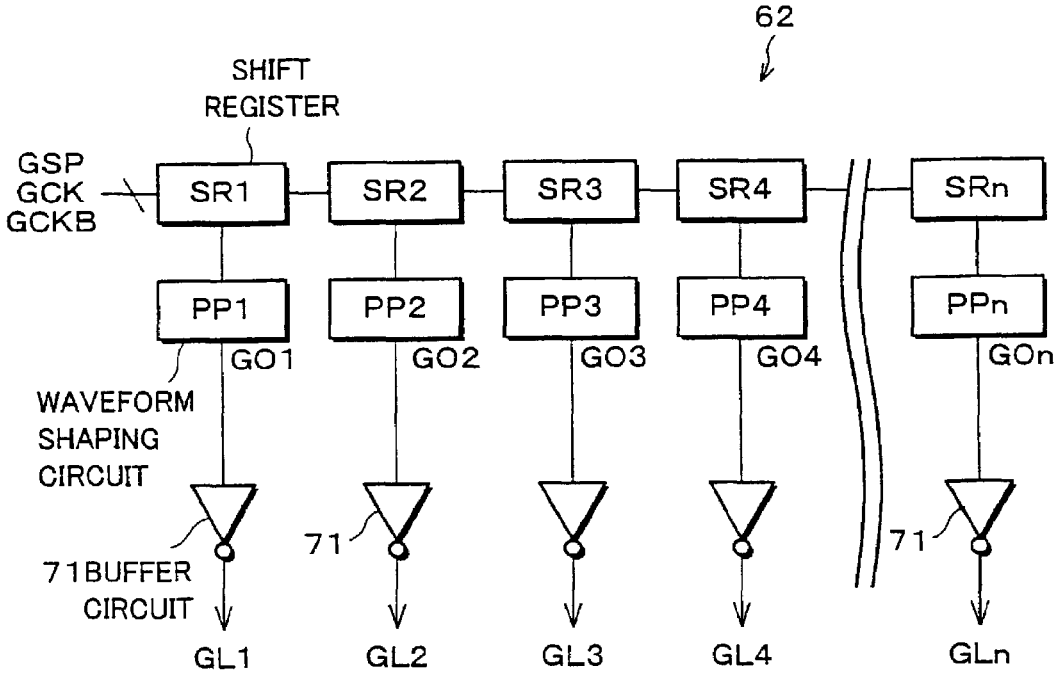
FIG. 13 PRIOR ART
FIG. 13 is a block diagram showing a structure of the scanning signal line driving circuit of a conventional matrix image display device.

This structure is the same structure as that of the described conventional common scanning signal line driving circuit 62, which is shown in FIG. 13, except for the resolution switching circuits 21.

Figure 7:
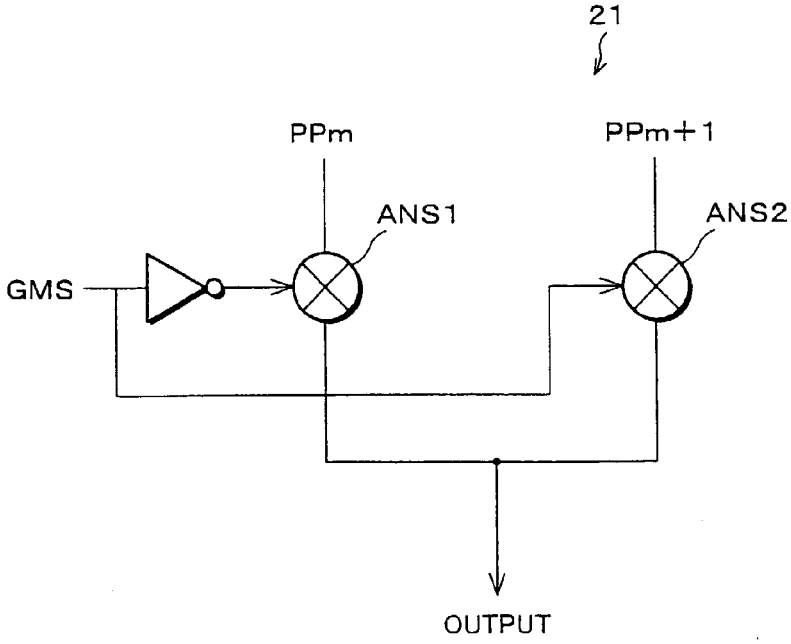
FIG. 7 is a block diagram showing a structure of a resolution switching circuit in the scanning signal line driving circuit.
Figure 8A:
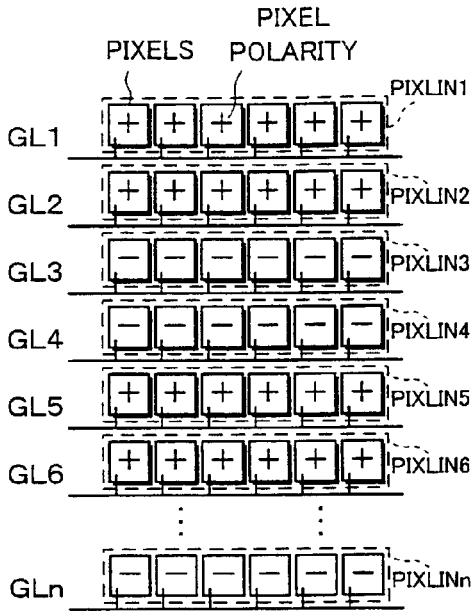
FIGS. 8(*a*) through 8(*d*) are explanatory views showing pixel polarities and their variances when driving is carried out in the scanning signal line driving circuit.
Figure 8B:
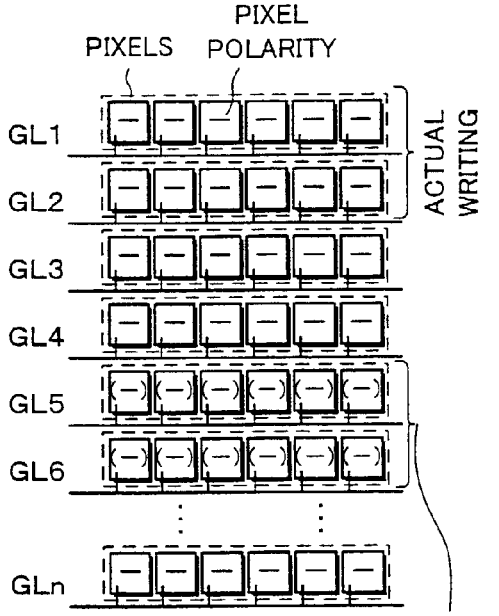
Figure 8C:
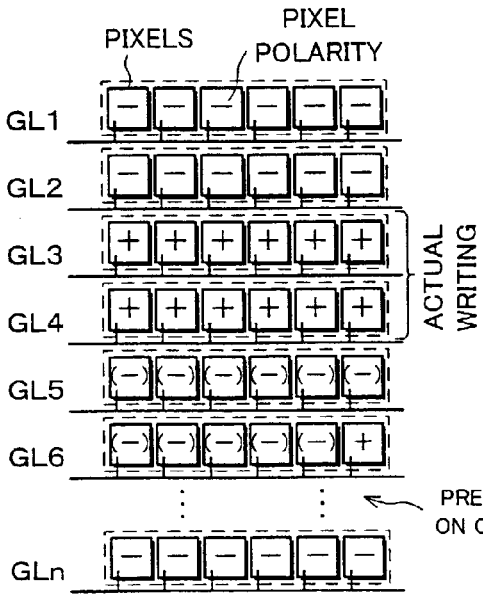
Figure 8D:
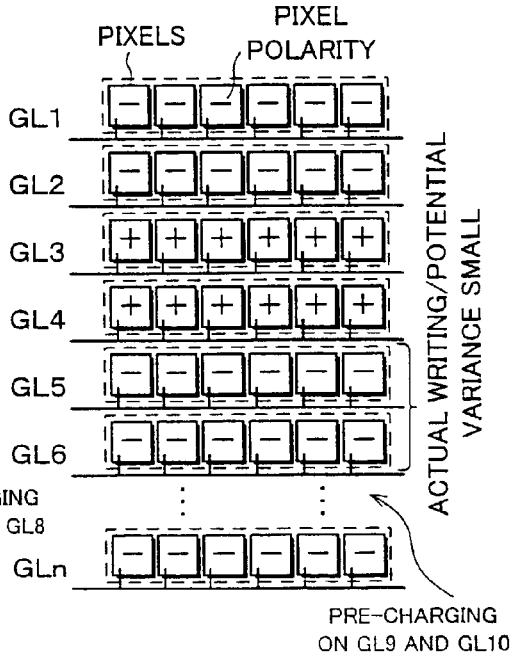

As shown in FIG. 7, each of the resolution switching circuits 21 is made of two analogue switches ANS1 and ANS2. These analogue switches ANS1 and ANS2 are not turned on at the same time, as they are respectively controlled by negative-phase (low potential) and positive-phase (high potential) of the externally outputted resolution switching signal GMS. Further, input for the analogue switches ANS1 and ANS2 is respectively carried out from the waveform shaping circuit PPm, and the waveform shaping circuits PPm+1 (m is a positive odd). The output of the analogue switches ANS1 and ANS2 is directed to a buffer circuit 22 corresponding to GOm+1.

Figure 14:
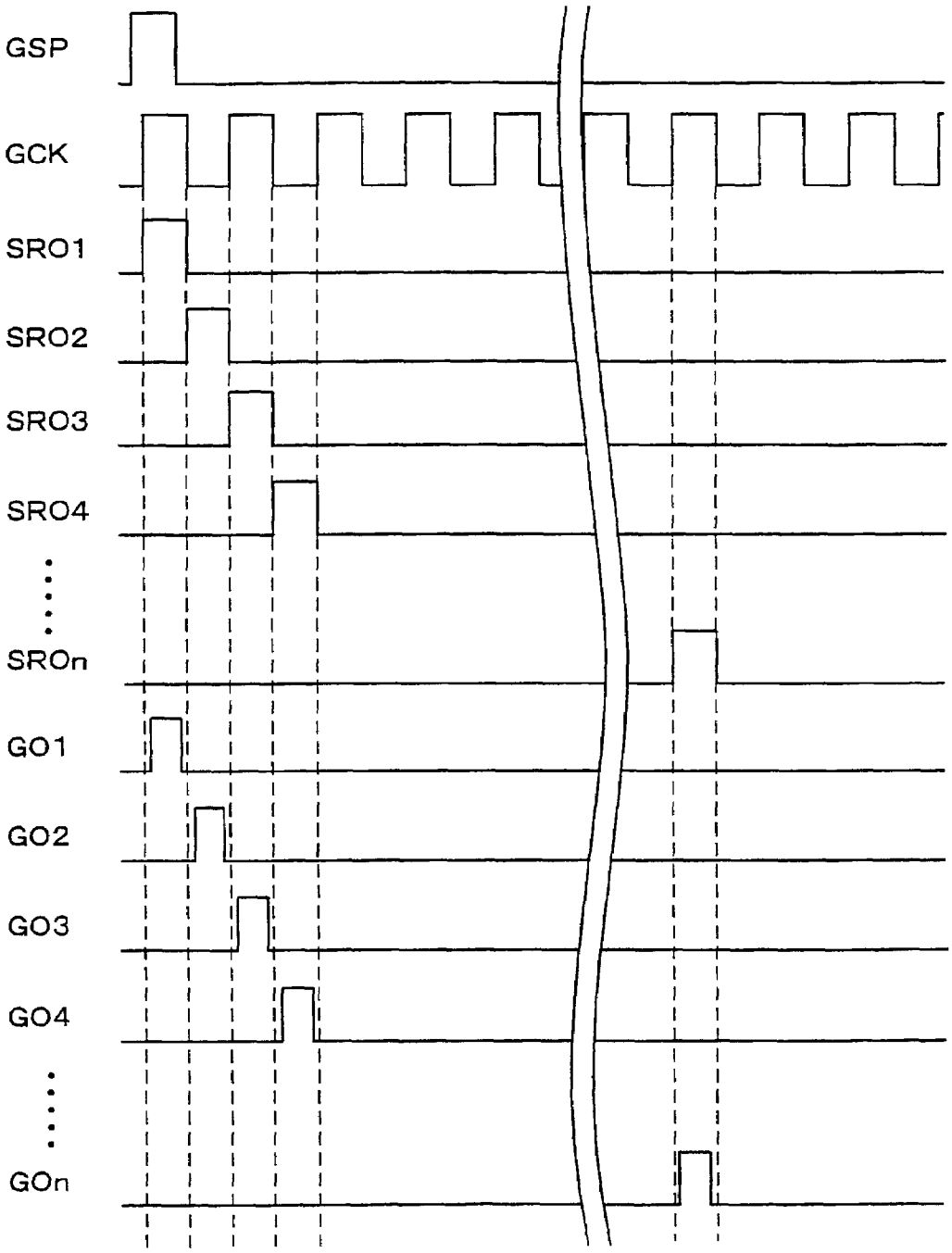
FIG. 14 PRIOR ART
FIG. 14 is a timing waveform chart showing a relation between a gate start pulse signal GSP, a gate clock signal GCK, output signals SRO1, SRO2, . . . SROn of shift registers, and output signals GO1 through GOn from waveform shaping circuits, which are related to the driving of the scanning signal line driving circuit.

Here, when the resolution switching signal GMS is in positive-phase (high potential), the analogue switch ANS1 is off and the analogue switch ANS2 is on, and therefore the waveform shaping circuit PPm+1 becomes effective as the input to the buffer circuit 22 corresponding to Gom+1. This is identical to the driving by the timing waveform of FIG. 14, which is an explanatory view of a conventional display device, and accordingly, the physical vertical resolution becomes maximum value.

Figure 15:
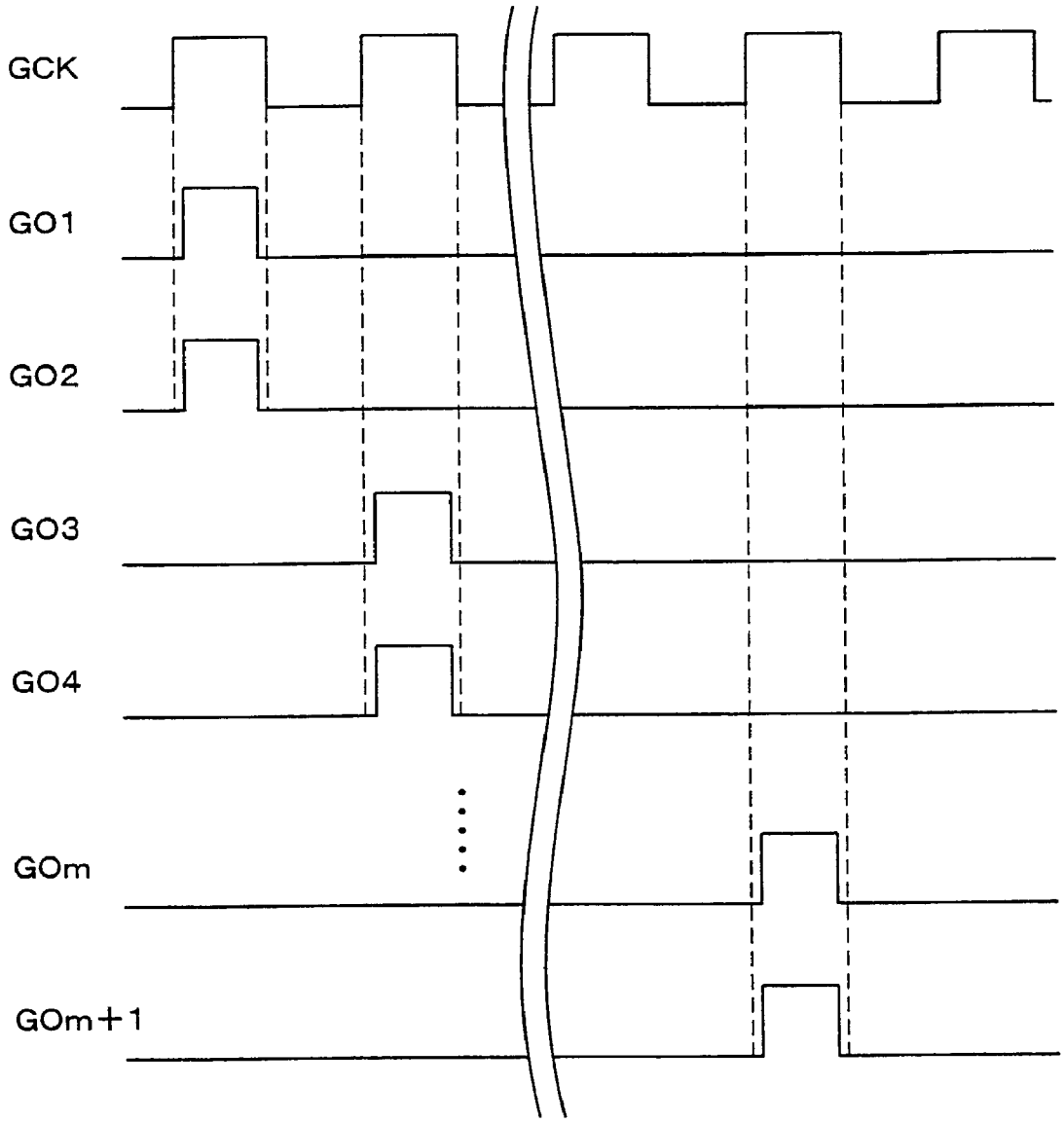
FIG. 15 PRIOR ART
FIG. 15 is a timing waveform chart showing a relation between a gate clock signal GCK, output signals GO1 through GOn from waveform shaping circuits, when ½ vertical resolution driving is carried out in the scanning signal line driving circuit.
Figure 16:
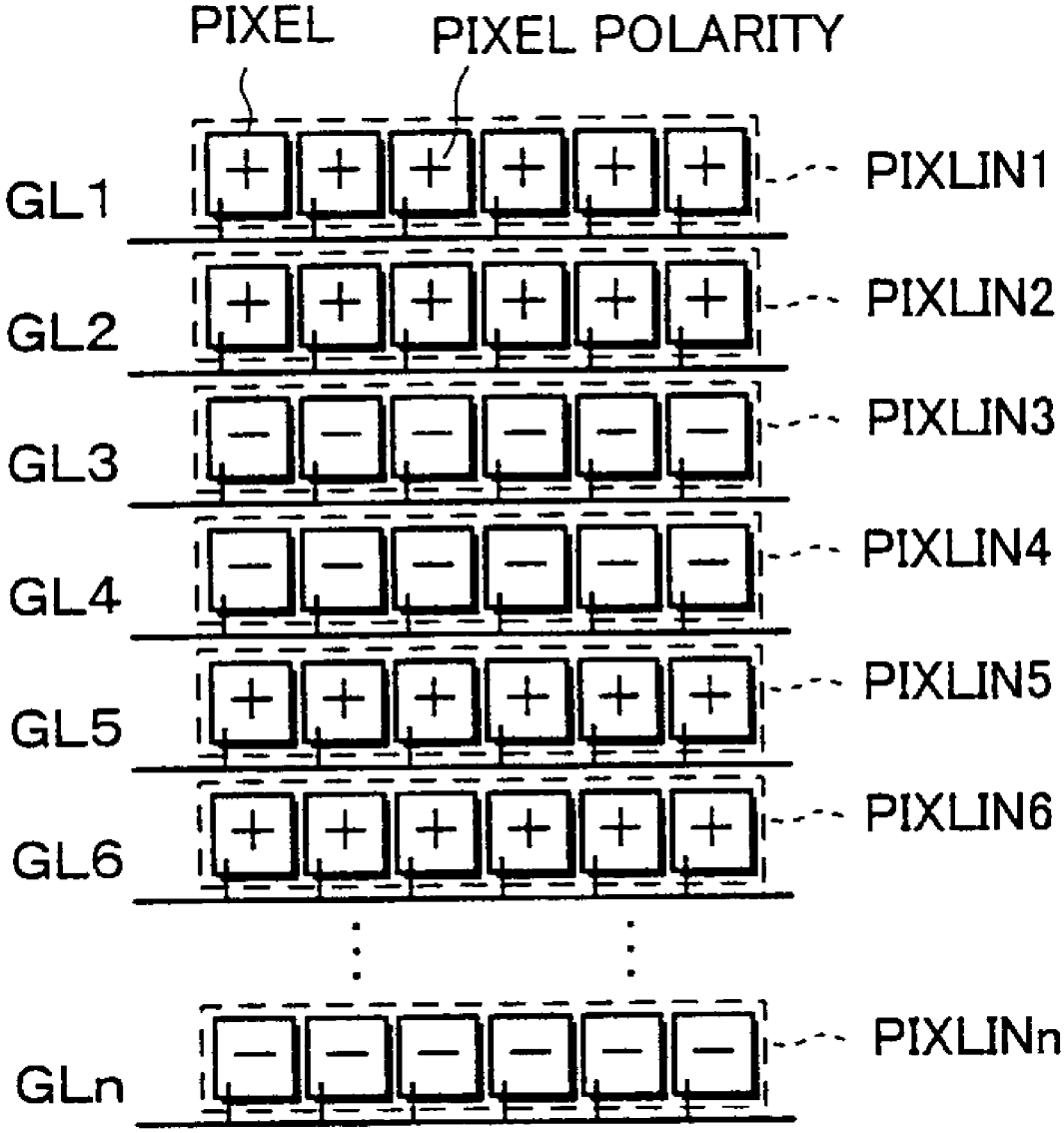
FIG. 16 PRIOR ART
FIG. 16 is an explanatory view showing pixel polarities when driving is carried out in the scanning signal line driving circuit.

On the other hand, when the resolution switching signal GMS is in negative-phase (low potential), the analogue switch ANS1 is on and the analogue switch ANS2 is off, and therefore the waveform shaping circuit PPm becomes effective as the input to the buffer circuit 22 corresponding to Gom+1. This is identical to the driving by the timing waveform of FIG. 15, which is another explanatory view of a conventional display device, and accordingly, the physical vertical resolution becomes ½ of the maximum value.

With the foregoing structure, it becomes possible to provide a matrix image display device capable of switching the visible vertical resolution.

The following will explain a characteristic driving method of the scanning signal line driving circuit 2 according to the present embodiment.

Figure 1:
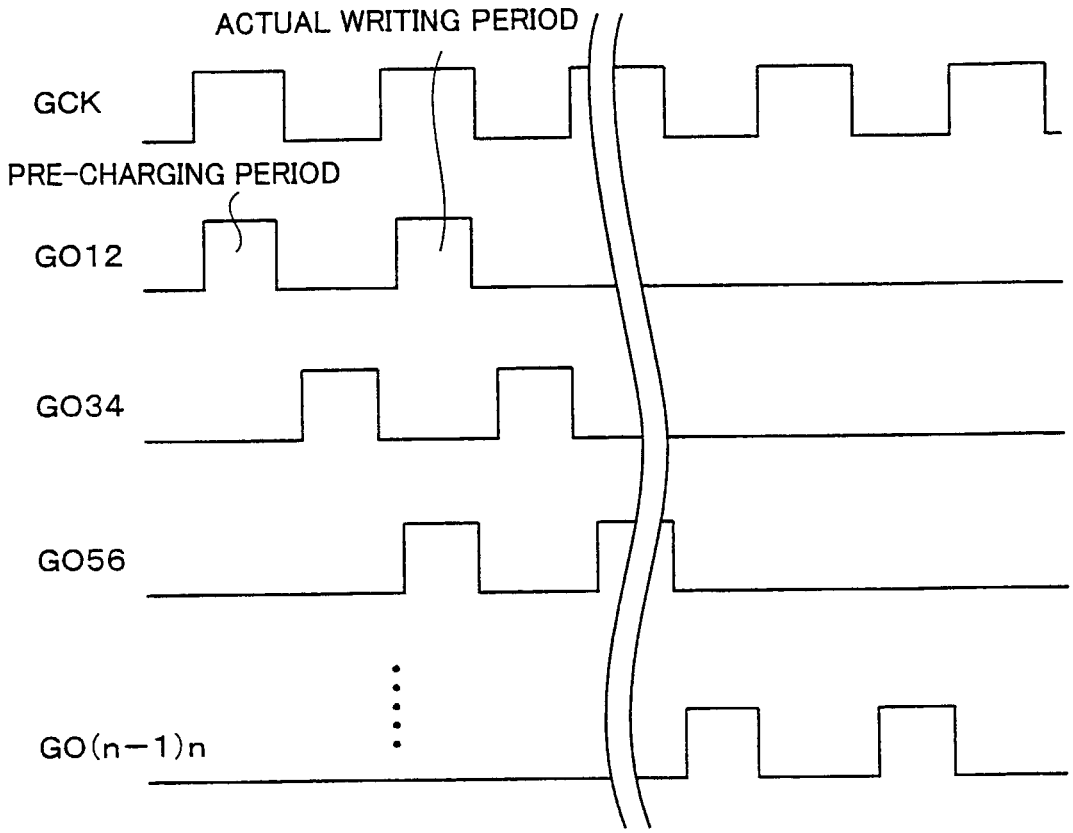
FIG. 1 is a timing waveform chart of a scanning signal line driving circuit according to one embodiment of a matrix image display device of the present invention.

Firstly, FIG. 1 shows timing waveforms for driving GL1, GL2, . . . GLn of scanning signal lines. Here, GO12 indicates the driving waveform of the scanning signal lines GL1 and GL2, GO34 indicates the driving waveform of the scanning signal lines GL3 and GL4, and GO (n−1) indicates the driving waveform of the scanning signal lines GLn−1 and GLn (n is an even number). Note that, the direction of the time axis is to the right in the figure.

In this case, the driving waveforms GO12, GO34, . . . GO (n−1) of each set of the scanning signal lines (GL1 and GL2, GL3 and GL4, . . . GLn−1 and GLn) respectively have two write timings. Namely, in the first write timing, the pixel lines corresponding to each of the scanning lines are precharged so as to increase potential to be closer to the actual writing potential. Then, in the second write timing, the actual potential writing is carried out.

More specifically, FIG. 8(*a*) shows the polarities of the pixel lines PIXLIN1, PIXLIN2, . . . PIXLINn corresponding to the scanning signal lines GL1 through GLn when scanning of 1 frame is finished, in the case of performing the 1H inversion driving in a matrix image display device adopting a liquid crystal element. Thereafter, as shown in FIG. 8(*b*), the inverted potentials of the scanning lines GL1 and GL2 are written on the next frame. Further, as shown in FIG. 8(*d*), inverted potentials of the scanning lines GL5 and GL6 are written on the next frame. In this manner, the inverted potentials are sequentially written to the scanning signal lines GLn−1 and GLn (n is a positive even number).

In the writing, the respective sets of the scanning signal lines GL1 and GL2, the scanning signal lines GL5 and GL6, the scanning signal lines GL9 and GL10, . . . the scanning signal lines GL (2n−3) and GL (2n−2) (n is a positive even number) are inverted to the same polarity.

On the other hand, the respective sets of the scanning signal lines GL3 and GL4, the scanning signal lines GL7 and GL8, the scanning signal lines GL11 and GL12, . . . the scanning signal lines GL (2n−1) and GL (2n) (n is a positive even number) are inverted to the opposite polarity of that of the scanning signal lines GL (2n−3) and GL (2n−2).

In the foregoing potential variances, potentials are written on the pixel lines with the driving timing shown in FIG. 1. Here, looking at the driving waveform GO34, which is the scanning signal lines GL3 and GL4, the potential variance of the pixel line PIXLIN2, from the set of pixel lines PIXLIN1 and PIXLIN2, affects the pixel line PIXLIN3, since the set of pixel lines PIXLIN1 and PIXLIN2 are disposed above and adjacent to the set of pixel lines PIXLIN3 and PIXLIN4 in the horizontal direction to the data signal line. Also, the potential variance of the pixel line PIXLIN5, from the set of pixel lines PIXLIN5 and PIXLIN6, affects the pixel line PIXLIN4, since the set of pixel lines PIXLIN5 and PIXLIN6 is disposed below and adjacent to the set of pixel lines PIXLIN3 and PIXLIN4.

However, as shown in FIG. 1, the potential variance of the pixel line PIXLIN2 is before the actual writing on the driving waveform GO34, and therefore it rarely affects the pixel line PIXLIN3.

On the other hand, the potential variance of the pixel line PIXLIN5 is after the actual writing on the driving waveform GO34, and therefore the potential variance of the pixel line PIXLIN5 affects the potential held by the pixel line PIXLIN4.

However, the first write timing, which is for pre-charging, of the driving waveform GO56 is before the actual writing on the driving waveform GO34, and identical to the actual writing of the driving waveform GO12. That is, the potential written on the set of pixel lines PIXLIN5 and PIXLIN6 corresponding to the driving waveform GO56 has the same value as which written on the set of pixel lines PIXLIN1 and PIXLIN2 corresponding to the driving waveform GO12.

Accordingly, since the set of pixel lines PIXLIN1 and PIXLIN2 corresponding to the driving waveform GO12, and the set of pixel lines PIXLIN5 and PIXLIN6 corresponding to the driving waveform GO56 are inverted to the same polarities, it also performs the pre-charging for the pixel line PIXLIN5. Further, the potential for the pre-charging is mostly close to the actual writing, since the potential for the actual writing on the nearest pixel is used for the potential of the pre-charging. Consequently, it is possible to reduce the potential variance at the actual writing of the pixel line PIXLIN5 to a minimum. That is, it is possible to suppress the effect of the pixel line PIXLIN5 on the pixel line PIXLIN4 to a minimum.

Figure 9:
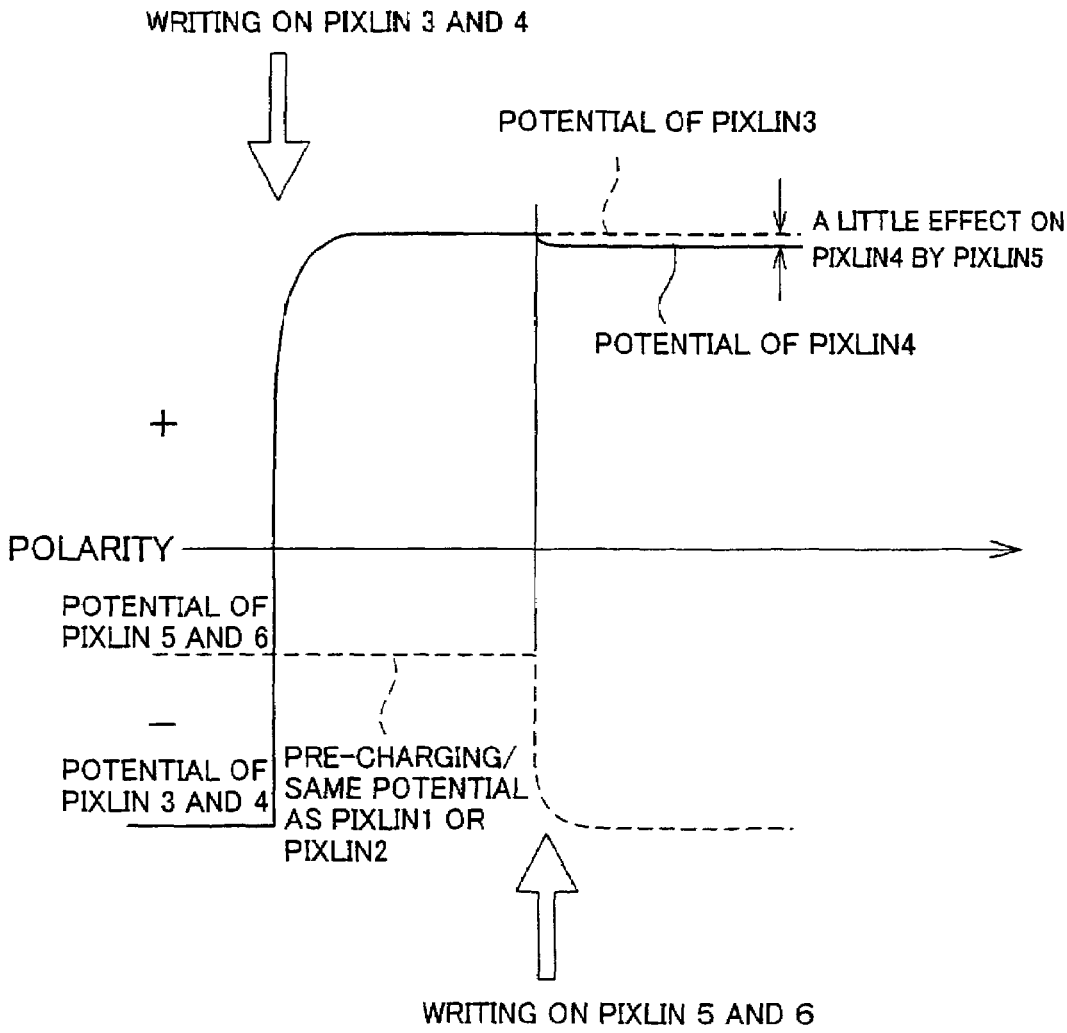
FIG. 9 is a waveform chart showing potential variances of pixel lines PIXLIN3 and PIXLIN 4 when driving is carried out in the scanning signal line driving circuit.
Figure 17:
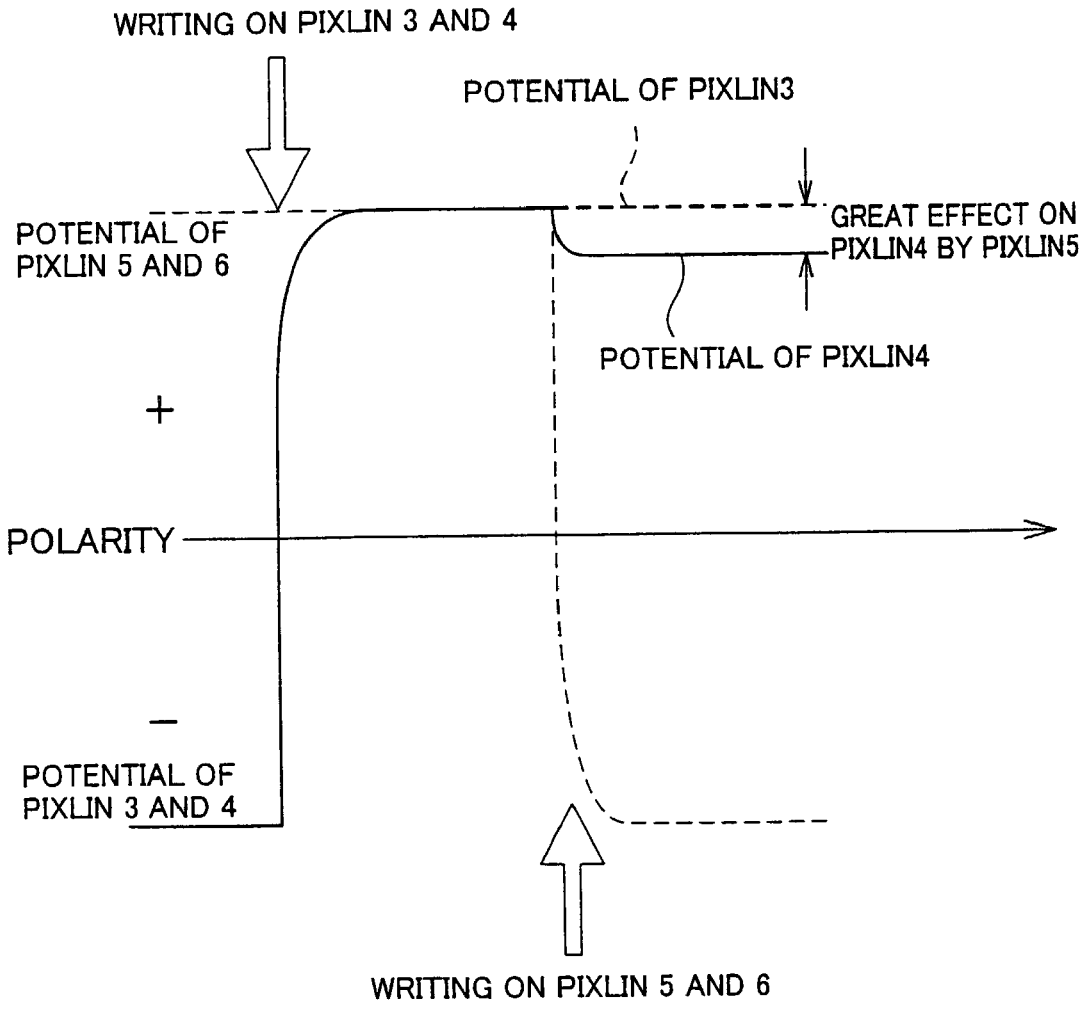
FIG. 17 PRIOR ART
FIG. 17 is a waveform chart showing potential variances of pixel lines PIXLIN3 and PIXLINE4 when driving is carried out in the scanning signal line driving circuit.
Figure 18A:
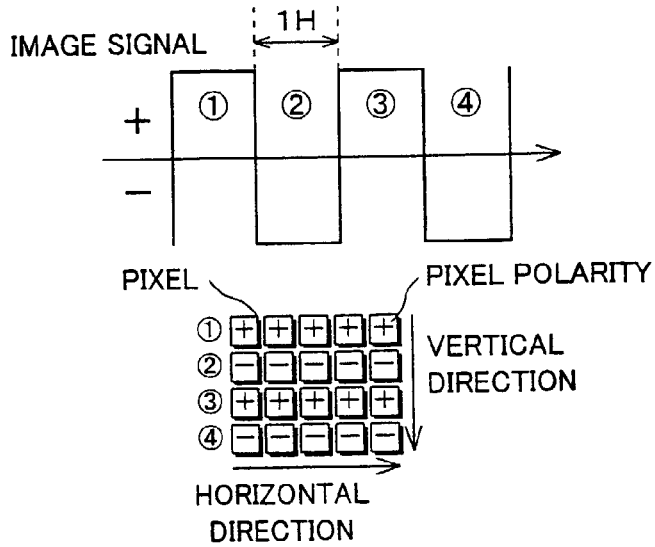
PRIOR ART FIG. 18(a)
FIG. 18(*a*) is an explanatory view showing 1H inversion driving which carries out inversion every 1 horizontal period, and FIG. 18(*b*) is an explanatory view showing 1V inversion driving which carries out inversion every 1 vertical period, and FIG. 18(*c*) is an explanatory view showing dot inversion driving which carries out inversion every 1 dot and every 1 vertical period.
Figure 18B:
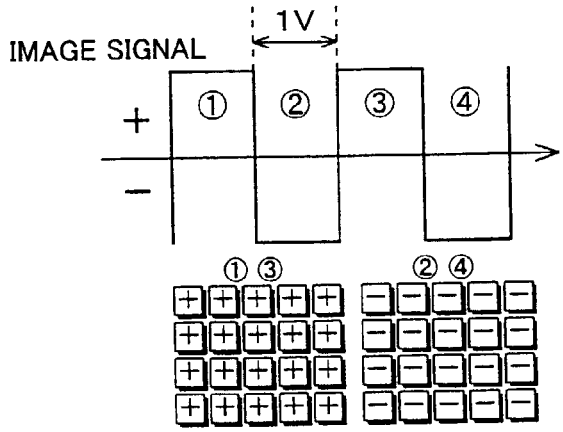
Figure 18C:
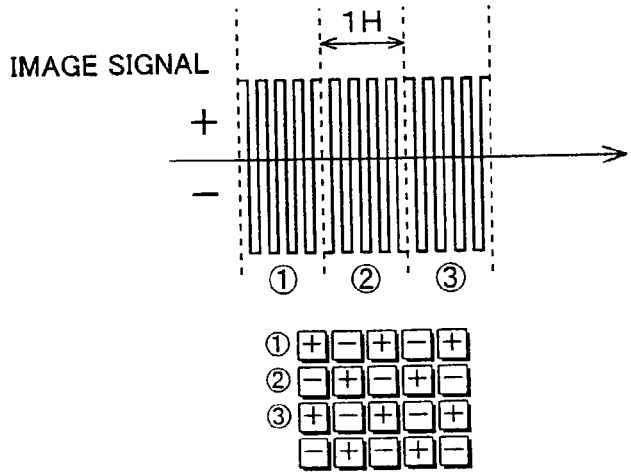

Accordingly, by the processes shown in FIGS. 8(*a*) through 8(*d*), the potential variances of the pixel lines PIXLIN3 and PIXLIN4 result in the states shown in FIG. 17 (conventional image display device) when no pre-charging is performed; and on the other hand, the potential variances of the pixel lines PIXLIN3 and PIXLIN4 result in the states shown in FIG. 9 when the pre-charging is performed as with the present embodiment.

Namely, the pixel line PIXLIN5 affects the pixel line PIXLIN4, and therefore the potential variance of the pixel line PIXLIN4 is proportional to the range of the potential variance of the pixel line PIXLIN5. Therefore, as shown in FIG. 9, the potential variance at the actual writing is suppressed by performing the pre-charging, thereby also suppressing the potential variance of the pixel line PIXLIN4.

Here, in the foregoing scanning signal line driving circuit 2, the driving method shown in FIG. 1, i.e., the driving method which ensures the pre-charging period and the actual writing period for driving the scanning signal lines GL1, GL2, . . . GLn can be realized by activating the start pulse signal GSP at plural times.

Figure 10:
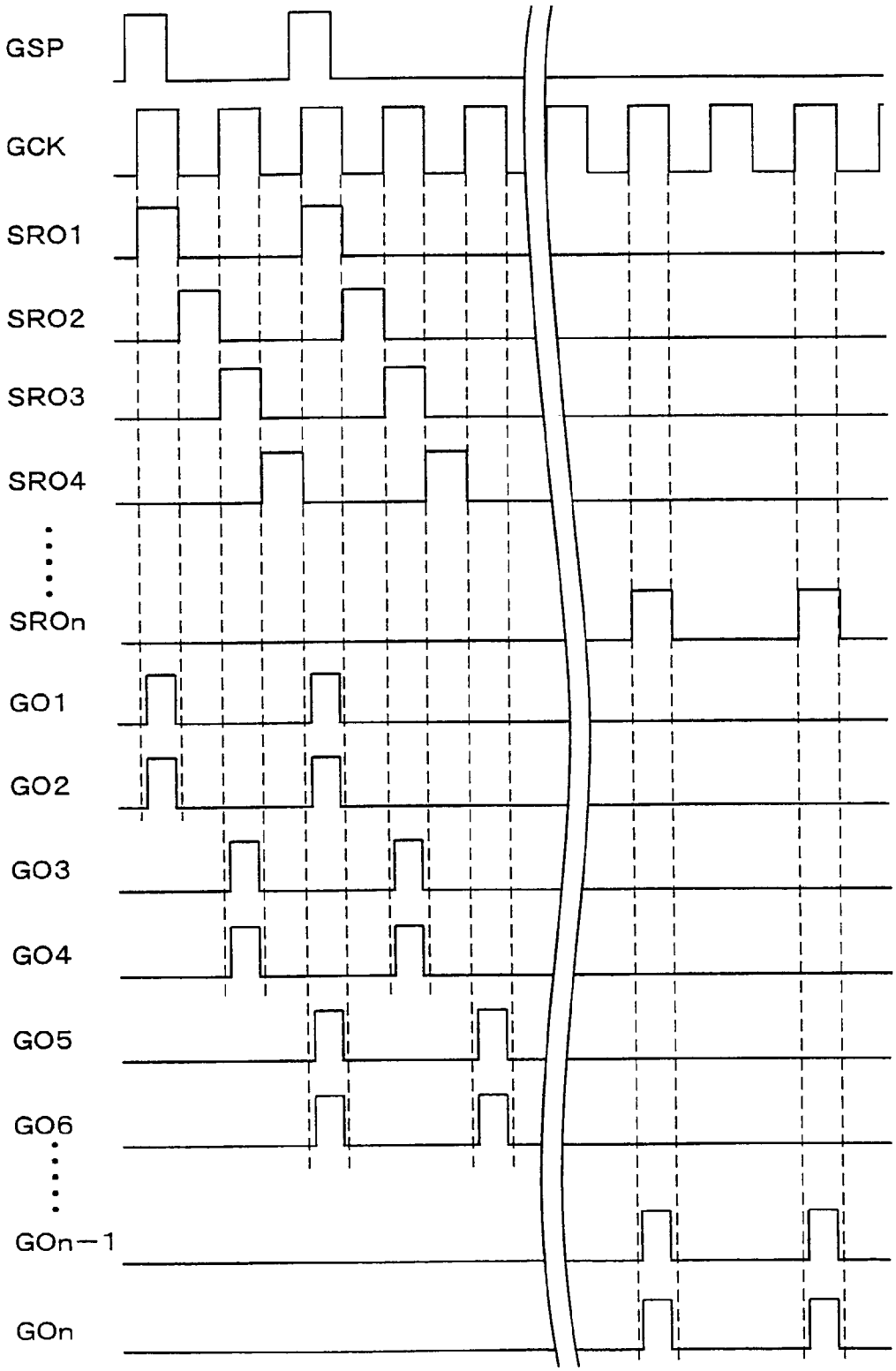
FIG. 10 is a timing waveform chart showing a relation between a gate start pulse signal GSP, a gate clock signal GCK, output signals SRO1, SRO2, . . . SROn of shift registers, and output signals GO1 through GOn from waveform shaping circuits, which are related to the driving of the scanning signal line driving circuit.
Figure 11:
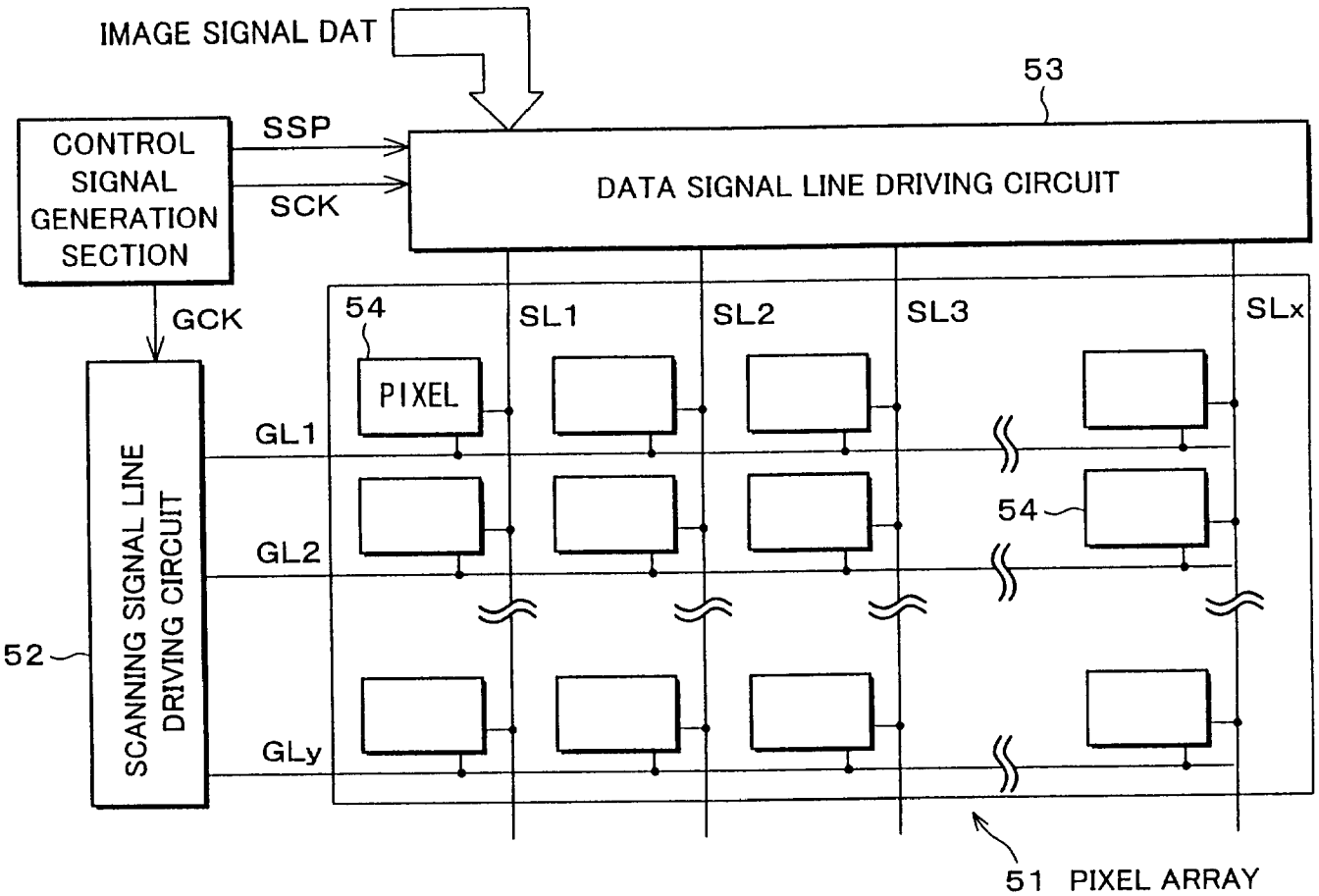
FIG. 11 PRIOR ART
FIG. 11 is a drawing showing a structure of a conventional matrix image display device.
Figure 12:
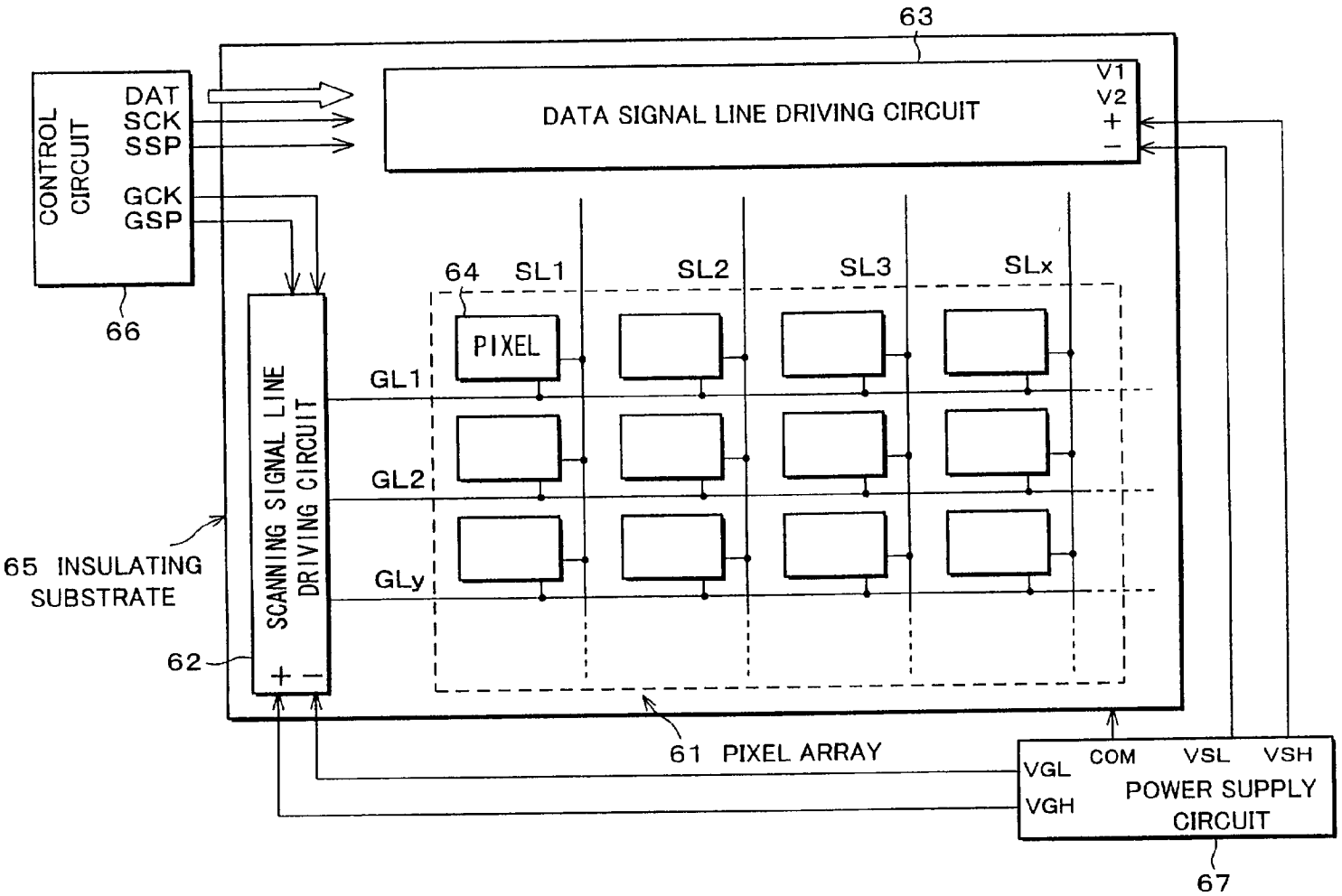
FIG. 12 PRIOR ART
FIG. 12 is a drawing showing a structure of another conventional matrix image display device.

FIG. 10 shows the timing waveform in the scanning signal line driving circuit 2 in the case of the ½ resolution display. In the figure, the gate start pulse signal GSP is activated two times so as to match a high period of the gate clock signal GCK.

As a result, in the shift registers SR1 through SRn, which shift the active state of the gate start pulse signal GSP, two active states are sequentially shifted by the shift registers SR1 and SR5, then shift registers SR2 and SR6, and outputted as the output signals SRO1, SRO2, . . . SROn of the shift registers SR1 through SRn as shown in the figure. The output signals are inputted to the waveform shaping circuits PP1 through PPn, and further, the outputs from the waveform shaping circuits PP1 through PPn are inputted to the resolution switching circuits 21, then outputted as the outputs GO1, GO2, . . . GOn.

FIG. 7 shows the arrangement of the resolution switching circuit 21 in the foregoing process. The resolution switching signal GMS is inputted in negative-phase (low potential) to the resolution switching circuit 21. The scanning signal lines GL1, GL2, . . . GLn are driven by the outputs GO1, GO2, . . . GOn so as to realize a driving method which ensures the pre-charging period and the actual writing in the pixel lines corresponding to the scanning signal lines GL1, GL2, . . . G1n.

By using the arrangement of the scanning signal line driving circuit 2 and the driving method of the scanning signal lines GL1 through GLn as thus described, it is possible to match the apparent vertical resolution of the device to that of the image source without irregularities in display quality when using an image signal of vertical resolution lower than the maximum physical vertical resolution of the device.

As has been described, in the matrix image display device of the present invention, the scanning signal line driving circuit sequentially carries out active driving with respect to each set of a certain number of scanning signal lines which are adjacent to each other in a vertical direction. For example, in the scanning signal lines GL1 through GLn, the scanning signal line driving circuit sequentially carries out driving with respect to each set of scanning signal lines GL2n−1 and GL2n (n is a positive even number), thereby obtaining ½ vertical resolution. Note that, in the present invention, the each set is made up of two scanning signal lines. However, it is not limited to two and it can be made up of three or four scanning signal lines.

Incidentally, in a conventional matrix image display device, when each set of scanning signal lines is driven in this manner, potential variances of the scanning signal lines above and below and adjacent to the set of scanning signal lines affect on a scanning signal of the set of scanning signal lines.

However, in the present embodiment, when carrying out an actual writing with respect to pixels 6 of a first set of a certain number of pixel lines adjacent to each other in the vertical direction, pre-charging is carried out with respect to a second set of the certain number of pixel lines to which the actual writing is carried out next with a potential of the same polarity as that of the first set of the certain number of pixel lines.

Accordingly, potential variance of the pixel line PIXLIN 2 of the first set of scanning signal line GL2 gives little effect on the scanning signal of the second set of scanning signal lines GL3 and GL4, since the pixel line PIXLIN2 of the first set are driven before the actual writing for the second set of scanning signal lines GL3 and GL4.

Meanwhile, potential variance of the first pixel line PIXLIN5 of the third set corresponding to the scanning signal line GL5 gives unwanted effect on the second set of the scanning signal lines GL3 and GL4.

However, in the present embodiment, the scanning line GL5 of the third set is pre-charged before the actual writing. Therefore, the potential variance of the pixel lines of the third set of the scanning signal lines GL5 and GL6 is suppressed when the actual writing is carried out. Further, the pre-charging is carried out with respect to the second set of the certain number of pixel lines PIXLIN5 and PIXLIN6 to which the actual writing is carried out next. The pre-charging is carried out at the same time of the actual writing of the first set of the certain number of pixel lines PIXLIN1 and PIXLIN2 with a potential of the same polarity. Namely, the pre-charging is carried out with the same potential as that of the actual writing.

As a result, it is possible to suppress the effect on the second set of the scanning signal lines GL3 and GL4 by the potential variance of the pixel lines of the third set of the scanning signal lines GL5 and GL6 since the potential variance of the pixel lines PIXLIN5 and PIXLIN6 corresponding to the third set of the scanning signal lines GL5 and GL6 is reduced.

Further, the potential for the actual writing on the nearest scanning signal lines GL1 and GL2 is used for the potential of the pre-charging with respect to the set of the scanning signal lines GL5 and GL6. Therefore, it is not necessary to input an extra signal for the pre-charging, and besides, the potential of the pre-charging is close to the potential of the actual writing.

Consequently, it is possible to provide a matrix image display device which has no irregularities in display quality and is capable of matching the apparent vertical resolution of the device to that of the image source, when using an image signal of vertical resolution lower than the maximum physical vertical resolution of the device.

With the foregoing invention, by using the selecting and switching means 21, it is possible to switch and select between the operation for respectively driving each of the scanning signal lines GL1 through GLn, and the operation for sequentially carrying out active driving with respect to each set of two scanning signal lines GLn−1 and GLn which are adjacent to each other in a vertical direction, and when carrying out an actual writing with respect to a first set of two pixel lines PIXLIN1 and PIXLIN2 adjacent to each other in the vertical direction, carrying out pre-charging with respect to a second set of two pixel lines PIXLIN5 and PIXLIN6 to which the actual writing is carried out next with a potential of the same polarity as that of the first set of two pixel lines PIXLIN1 and PIXLIN2.

Consequently, it is possible to maintain high quality of both high vertical resolution display and low vertical resolution display.

Further, in the matrix image display device of the present embodiment, the active driving is sequentially carried out with respect to each set of the certain number of scanning signal lines GLn−1 and GLn which are adjacent to each other in the vertical direction so that potentials of the same value are written to the pixels PIXLINn−1 and PIXLINn corresponding to the set of the certain number of scanning signal lines GLn−1 and GLn thus driven.

Further, in the matrix image display device of the present embodiment, polarities of the image signal DAT supplied to the data signal lines SL1, SL2, . . . SLx may be inverted for each horizontal period.

Further, in the matrix image display device of the present embodiment, polarities of the image signal supplied to the data signal lines may be inverted for each dot and for each horizontal period.

This is because, when the 1H inversion driving which inverts the polarity every horizontal period, and the dot inversion driving which inverts the polarity every dot and every horizontal period, are adopted for the image signal DAT supplied to the data signal lines SL1, SL2, . . . SLx, the polarities of the adjacent pixels in a horizontal direction of the data signal lines differ each other and therefore potentials greatly vary in the writing on pixels.

Therefore, the driving method of the present embodiment provides a great effect in such case.

Further, in the matrix image display device of the present embodiment, the data signal line driving circuit 3, the scanning signal line driving circuit 2 and the pixels 6 are provided on the same insulating substrate 11. By thus providing the scanning signal line driving circuit 2 with the foregoing functions on the same substrate as that of the data signal line driving circuit 3 and the pixels 6, it is possible to provide an effect of lower mounting cost, and also results in an effect of high-reliability.

Further, in the matrix image display device of the present embodiment, the data signal line driving circuit 3, the scanning signal line driving circuit 2 and active elements which composes the pixels 6 are respectively made of polycrystalline silicon thin film transistors. This makes it possible to provide the driving circuits 2 and 3, and the pixels 6 on the same substrate with the same manufacturing process, thereby reducing manufacturing cost.

Further, in the matrix image display device of the present embodiment, the active elements are formed on a glass substrate by a manufacturing process of at or lower than 600° C. By thus forming the polycrystalline silicon thin film transistors on the grass substrate by a manufacturing process of at or lower than 600° C., it is possible to adopt a low-melting grass substrate of lower cost, thereby providing the matrix image display device with lower cost.

Note that, the present invention is not limited to those embodiments above, and the same may be varied in many ways within the scope of the present invention. Namely, the present invention may be applied to the other arrangements using signals of different number, different kind, and different polarity.

In the embodiment above, the scanning signals supplied to the adjacent scanning signal lines GL1 through GLn are in phase; however, the scanning signals supplied to the adjacent scanning signal lines GL1 through GLn may also be out of phase.

Further, as described, in the matrix image display device of the present embodiment, the pre-charging is carried out with respect to both of the pixel lines PIXLIN5 and PIXLIN6 corresponding to the scanning signal lines GL5 and GL6, which are driven next to the two scanning signal lines GL3 and GL4, for example.

However, in order to prevent the irregularities in display quality, as long as the unwanted effect of the potential variance of the pixel line PIXLIN5 in the earliest line is suppressed, it is not necessary to suppress the effect of both pixel lines PIXLIN5 and PIXLIN6 of the set to which the actual writing is carried out next to the scanning signal lines GL3 and GL4.

Therefore, in the scanning signal line driving circuit 2 of the present embodiment, when the actual writing is carried out with respect to the first set of two pixel lines PIXLIN1 and PIXLIN2 corresponding to the scanning signal lines GL1 and GL2, the pre-charging can be carried out with respect to the pixel line PIXLIN5 in the earliest line of the second set of two scanning signal lines GL5 and GL6 to which the actual writing is carried out next with the same potential as that of the PIXLIN1 and PIXLIN2 corresponding to the scanning signal lines GL1 and GL2.

As a result, the pre-charging consumes minimum power, and power consumption can be reduced.

As described, in the matrix image display device of the present embodiment, the active driving is sequentially carried out with respect to each set of the certain number of scanning signal lines which are adjacent to each other in the vertical direction so that potentials of the same value are written to the pixels corresponding to the set of the certain number of scanning signal lines thus driven.

Further, in the matrix image display device of the present invention, the scanning signals supplied to the set of the certain number of scanning signal lines are in phase or out of phase when the active driving is sequentially carried out with respect to each set of the certain number of scanning signal lines which are adjacent to each other in the vertical direction.

Further, in the matrix image display device of the present invention, polarities of the image signals supplied to the data signal lines are inverted for each horizontal period.

Further, in the matrix image display device of the present invention, polarities of the image signals supplied to the data signal lines are inverted for each dot and for each horizontal period.

This is because, when the 1H inversion driving which inverts the polarity every horizontal period, and the dot inversion driving which inverts the polarity every dot and every horizontal period, are adopted for the image signal supplied to the data signal lines, the polarities of the adjacent pixels in a horizontal direction of the data signal lines differ each other and therefore potentials greatly vary in the writing on pixels.

Therefore, the driving method of the present embodiment provides a great effect in such case.

Further, in the matrix image display device of the present invention, the data signal line driving circuit, the scanning signal line driving circuit and the pixels are provided on a same substrate.

By thus providing the scanning signal line driving circuit with the foregoing functions on the same substrate as that of the data signal line driving circuit and the pixels, it is possible to provide an effect of lower mounting cost, and also results in an effect of high-reliability.

Further, in the matrix image display device of the present invention, the data signal line driving circuit, the scanning signal line driving circuit and active elements which composes the pixels are respectively made of polycrystalline silicon thin film transistors.

This makes it possible to provide the driving circuits and the pixels on the same substrate with the same manufacturing process, thereby reducing manufacturing cost.

Further, in the matrix image display device of the present invention, the active elements are formed on a glass substrate by a manufacturing process of at or lower than 600° C.

By thus forming the polycrystalline silicon thin film transistors on the grass substrate by a manufacturing process of at or lower than 600° C., it is possible to adopt a low-melting grass substrate of lower cost, thereby providing the matrix image display device with lower cost.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A matrix image display device comprising:

a plurality of pixels disposed in a matrix manner;

a plurality of data signal lines disposed on columns of the respective pixels, and a plurality of scanning signal lines disposed corresponding to lines of the respective pixels;

a display section which accepts and holds image signals for displaying images in the respective pixels from the data signal lines in synchronism with scanning signals supplied from the scanning signal lines;

a data signal line driving circuit which outputs the image signals to the respective data signal lines in synchronism with predetermined timing signals for the respective data signal lines; and a scanning signal line driving circuit which outputs the scanning signals to the respective scanning signal lines in synchronism with predetermined timing signals for the respective scanning signal lines, wherein:

the scanning signal line driving circuit (a) sequentially carries out active driving with respect to each set of a certain number of scanning signal lines which are adjacent to each other in a vertical direction, and when carrying out an actual writing with respect to a first set of a certain number of pixel lines adjacent to each other in the vertical direction using a corresponding first set of scanning signal lines, (b) carries out pre-charging with respect to a second set of the certain number of pixel lines to which the actual writing is carried out thereafter, using a second set of scanning signal lines different than the first set of scanning signal lines, wherein the pre-charging is performed with a potential of a same polarity as that of the first set of the certain number of pixel lines.

2. A matrix image display device comprising:

a plurality of pixels disposed in a matrix manner;

a plurality of data signal lines disposed on columns of the respective pixels, and a plurality of scanning signal lines disposed corresponding to lines of the respective pixels;

a display section which accepts and holds image signals for displaying images in the respective pixels from the data signal lines in synchronism with scanning signals supplied from the scanning signal lines;

a data signal line driving circuit which outputs the image signals to the respective data signal lines in synchronism with predetermined timing signals for the respective data signal lines; and a scanning signal line driving circuit which outputs the scanning signals to the respective scanning signal lines in synchronism with predetermined timing signals for the respective scanning signal lines, wherein:

the scanning signal line driving circuit (a)sequentially carries out active driving with respect to each set of a certain number of scanning signal lines which are adjacent to each other in a vertical direction, and when carrying out an actual writing with respect to a first set of a certain number of pixel lines adjacent to each other in the vertical direction using a corresponding first set of scanning lines, (b) carries out pre-charging with respect to pixels in an earliest line of a second set of the certain number of pixel lines to which the actual writing is carried out thereafter, using a second set of scanning signal lines different than the first set of scanning signal lines, wherein the pre-charging is performed with a potential of a same polarity as that of the first set of the certain number of pixel lines.

3. A matrix image display device comprising:

a plurality of pixels disposed in a matrix manner;

a plurality of data signal lines disposed on columns of the respective pixels, and a plurality of scanning signal lines disposed corresponding to lines of the respective pixels;

a display section which accepts and holds image signals for displaying images in the respective pixels from the data signal lines in synchronism with scanning signals supplied from the scanning signal lines;

a data signal line driving circuit which outputs the image signals to the respective data signal lines in synchronism with predetermined timing signals for the respective data signal lines; and a scanning signal line driving circuit which outputs the scanning signals to the respective scanning signal lines in synchronism with predetermined timing signals for the respective scanning signal lines, wherein:

the scanning signal line driving circuit includes:

selecting and switching means for switching between;

(i)an operation for respectively driving each of the scanning signal lines, and (ii)an operation for (a) sequentially carrying out active driving with respect to each set of a certain number of scanning signal lines which are adjacent to each other in a vertical direction, and when carrying out an actual writing with respect to a first set of a certain number of pixel lines adjacent to each other in the vertical direction using a first set of scanning signal lines, (b) carrying out pre-charging with respect to a second set of the certain number of pixel lines to which the actual writing is carried out thereafter, using a second set of scanning signal lines different than the first set of scanning signal lines, wherein the pre-charging is performed with a potential of a same polarity as that of the first set of the certain number of pixel lines.

4. The matrix image display device as set forth in claim 1, wherein:

the active driving is sequentially carried out with respect to each set of the certain number of scanning signal lines which are adjacent to each other in the vertical direction so that potentials of a same value are written to the pixels corresponding to the set of the certain number of scanning signal lines thus driven.

5. The matrix image display device as set forth in claim 2, wherein: the active driving is sequentially carried out with respect to each set of the certain number of scanning signal lines which are adjacent to each other in the vertical direction so that potentials of a same value are written to the pixels corresponding to the set of the certain number of scanning signal lines thus driven.

6. The matrix image display device as set forth in claim 3, wherein: the active driving is sequentially carried out with respect to each set of the certain number of scanning signal lines which are adjacent to each other in the vertical direction so that potentials of a same value are written to the pixels corresponding to the set of the certain number of scanning signal lines thus driven.

7. The matrix image display device as set forth in claim 1, wherein: the scanning signals supplied to the set of the certain number of scanning signal lines are in phase or out of phase when the active driving is sequentially carried out with respect to each set of the certain number of scanning signal lines which are adjacent to each other in the vertical direction.

8. The matrix image display device as set forth in claim 2, wherein: the scanning signals supplied to the set of the certain number of scanning signal lines are in phase or out of phase when the active driving is sequentially carried out with respect to each set of the certain number of scanning signal lines which are adjacent to each other in the vertical direction.

9. The matrix image display device as set forth in claim 3, wherein: the scanning signals supplied to the set of the certain number of scanning signal lines are in phase or out of phase when the active driving is sequentially carried out with respect to each set of the certain number of scanning signal lines which are adjacent to each other in the vertical direction.

10. The matrix image display device as set forth in claim 1, wherein: polarities of the image signals supplied to the data signal lines are inverted for each horizontal period.

11. The matrix image display device as set forth in claim 2, wherein: polarities of the image signals supplied to the data signal lines are inverted for each horizontal period.

12. The matrix image display device as set forth in claim 3, wherein: polarities of the image signals supplied to the data signal lines are inverted for each horizontal period.

13. The matrix image display device as set forth in claim 1, wherein: polarities of the image signals supplied to the data signal lines are inverted for each dot and for each horizontal period.

14. The matrix image display device as set forth in claim 2, wherein: polarities of the image signals supplied to the data signal lines are inverted for each dot and for each horizontal period.

15. The matrix image display device as set forth in claim 3, wherein: polarities of the image signals supplied to the data signal lines are inverted for each dot and for each horizontal period.

16. The matrix image display device as set forth in claim 1, wherein: the data signal line driving circuit, the scanning signal line driving circuit and the pixels are provided on a same substrate.

17. The matrix image display device as set forth in claim 2, wherein: the data signal line driving circuit, the scanning signal line driving circuit and the pixels are provided on a same substrate.

18. The matrix image display device as set forth in claim 3, wherein: the data signal line driving circuit, the scanning signal line driving circuit and the pixels are provided on a same substrate.

19. The matrix image display device as set forth in claim 16, wherein: active elements which compose the data signal line driving circuit, the scanning signal line driving circuit and the pixels are respectively made of polycrystalline silicon thin film transistors.

20. The matrix image display device as set forth in claim 17, wherein: active elements which compose the data signal line driving circuit, the scanning signal line driving circuit and the pixels are respectively made of polycrystalline silicon thin film transistors.

21. The matrix image display device as set forth in claim 18, wherein: active elements which compose the data signal line driving circuit, the scanning signal line driving circuit and the pixels are respectively made of polycrystalline silicon thin film transistors.

22. The matrix image display device as set forth in claim 19, wherein: the active elements are formed on a glass substrate by a manufacturing process of at or lower than 600° C.

23. The matrix image display device as set forth in claim 20, wherein: the active elements are formed on a glass substrate by a manufacturing process of at or lower than 600° C.

24. The matrix image display device as set forth in claim 21, wherein: the active elements are formed on a glass substrate by a manufacturing process of at or lower than 600° C.

25. The device of claim 1, wherein a third set of scanning signal lines for another set of pixels is located between the first set of scanning signal lines and the second set of scanning signal lines to that the another set of pixels are located between pixels being driven using the first set of scanning signal lines and the second set of scanning signal lines being subjected to pre-charging.

26. The device of claim 2, wherein a third set of scanning signal lines for another set of pixels is located between the first set of scanning signal lines and the second set of scanning signal lines to that the another set of pixels are located between pixels being driven using the first set of scanning signal lines and the second set of scanning signal lines being subjected to pre-charging.

27. The device of claim 3, wherein a third set of scanning signal lines for another set of pixels is located between the first set of scanning signal lines and the second set of scanning signal lines to that the another set of pixels are located between pixels being driven using the first set of scanning signal lines and the second set of scanning signal lines being subjected to pre-charging.

* * * * *